US005797077A

United States Patent [19]

Samizo et al.

[11] Patent Number: 5,797,077

[45] Date of Patent: Aug. 18, 1998

[54] DOUBLE-SIDED IMAGES FORMING APPARATUS AND METHOD USING THE SAME

[75] Inventors: Ken Samizo; Kenichi Mishina; Mituo Yamamoto; Yutaka Yakabe; Toshikazu Kageyama; Yoshiya Mashimo, all of Ebina, Japan

[73] Assignee: Fuji Xerox Co., Ltd., Tokyo, Japan

[21] Appl. No.: 825,622

[22] Filed: Mar. 31, 1997

[30] Foreign Application Priority Data

| | | | |
|---|---|---|---|
| Apr. 4, 1996 | [JP] | Japan | 8-108449 |
| Feb. 6, 1997 | [JP] | Japan | 9-036907 |
| Feb. 17, 1997 | [JP] | Japan | 9-048492 |

[51] Int. Cl.[6] ..... G03G 15/16; G03G 15/01

[52] U.S. Cl. ..... 399/309; 399/302; 399/298

[58] Field of Search ..... 399/309, 308, 399/302, 306, 299, 298, 297; 355/24; 430/124, 126

[56] References Cited

U.S. PATENT DOCUMENTS

| | | | |
|---|---|---|---|
| 4,714,939 | 12/1987 | Ahern et al. | 399/309 |
| 5,132,721 | 7/1992 | Randall . | |
| 5,138,389 | 8/1992 | Randall | 399/302 |
| 5,453,822 | 9/1995 | Anzai et al. | 399/299 |
| 5,550,624 | 8/1996 | Wachtler | 399/306 |
| 5,640,645 | 6/1997 | Namekata et al. | 399/302 X |
| 5,671,464 | 9/1997 | Kubota | 399/302 X |
| 5,697,031 | 12/1997 | Kamiya et al. | 399/302 X |

FOREIGN PATENT DOCUMENTS

| | | |
|---|---|---|
| 63-63057 | 3/1988 | Japan . |
| 2-221971 | 9/1990 | Japan . |
| 2-259670 | 10/1990 | Japan . |
| 3-068965 | 3/1991 | Japan . |
| 3-155570 | 7/1991 | Japan . |
| 6-118811 | 4/1994 | Japan . |

*Primary Examiner*—Matthew S. Smith
*Attorney, Agent, or Firm*—Oliff & Berridge, PLC

[57] ABSTRACT

A double-sided image forming method is disclosed which comprising; a first image primary transfer step (A) for transferring a first image (T1) carried by a first image carrier (1) to a first intermediate transfer member (2); a second image primary transfer step (B) for transferring a second image (T2) carried by a second image carrier (3) to a second intermediate transfer member (4); and a secondary image transfer step (C) for secondarily transferring the primarily transferred images (T1) and (T2) from the respective intermediate transfer members (2) and (4) to both sides of recording material (5), in the area where the first intermediate transfer material (2) and the second intermediate transfer material (4) come into contact with or in proximity to each other.

23 Claims, 20 Drawing Sheets

DOUBLE-SIDED IMAGES FORMING APPARATUS AND METHOD USING THE SAME

BACKGROUND OF THE INVENTION

The present invention relates to an image forming method and apparatus for used in; e.g., an electrophotographic copier or a printer. Particularly, the present invention relates to improved double-sided image forming method and apparatus capable of double-sided images.

In a conventional common double-sided image forming apparatus, paper is reversed after a first image formed on a latent image carrier, such as a photosensitive member, has been transferred to and fixed on a first plane of the paper. The thus-reversed paper is again fed to an image forming section, and a second image formed on the latent image carrier is then transferred to and fixed on a second plane of the paper.

Since this apparatus causes the paper to pass through the image forming section twice, per-paper productivity is reduced to less than half the productivity obtained when an image is formed on one side of the paper. The paper curls up after having been subjected to a fixing operation first time. When the paper is subjected to the transfer and fixing operations second time, transfer errors arise, or the paper becomes crumpled. Alternatively, the paper is likely to cause paper jams during the course of its travel to the image forming section. Further, reversing and refeeding of the paper involve noise.

To solve these problems,there already exists a double-sided image forming apparatus (as disclosed in; e.g., Unexamined Japanese Patent Application Nos. Sho-63-63057 and Hei-2-259670). In this apparatus, two photosensitive members are disposed so as to be opposite to each other. After a first toner image (or a first image) and a second toner image (or a second image) have been formed on the respective photosensitive members, the toner images thus formed on the respective photosensitive members are simultaneously transferred to both sides of paper, respectively.

However, this type of double-sided image forming apparatus presents the following problems:

First, since the images are transferred by utilization of the potential difference between the photosensitive members, the transfer efficiency of the apparatus is worse than that of the apparatus which uses a transfer device.

Second, it is difficult to control the gap between the hard photosensitive members. If the gap is too narrow, the paper causes impact when entering the fixing unit, thereby rendering a resultant image distorted. In contrast, if the gap is too wide, transfer errors will arise. Therefore, it is necessary to limit the thickness of usable paper or to control the gap according to each paper thickness.

Third, since the photosensitive members are affected by heat, they cannot be positioned in proximity to a fixing unit. It is difficult to maintain the attitude of the paper while the paper having unfixed images on both sides thereof is transferred from the transfer position to the fixing unit without special transfer means. As a result, the attitude of the paper becomes unstable when entering the fixing unit, which in turn makes a resultant toner image distorted or makes the paper crumpled.

As a prior art apparatus to solve the foregoing technological drawbacks, there exists an apparatus (as disclosed in U.S. Pat. No. 5,132,721) which directly transfers a toner image to one side of the paper from a first photosensitive member and then transfers another toner image from a second photosensitive member to the other side of the paper through an intermediate transfer member.

This apparatus is capable of ensuring transfer of images to the first and second sides of the paper. Further, the paper is transferred to the fixing unit while being sucked by the intermediate transfer member, which makes it possible to maintain the attitude of the paper. In this way, the apparatus is capable of increasing productivity as well as of solving the technical drawbacks.

However, in this type of double-sided image forming apparatus, the paper is sucked by the intermediate transfer member after the toner image has been transferred on the first plane of the paper. It is difficult to pass the paper to the intermediate transfer member from the photosensitive member. The toner image formed on the first plane of the paper is apt to become retransferred to the photosensitive member, or the toner image becomes distorted.

Further, in a case where the image is transferred to the paper through the intermediate transfer member, an image is transferred twice; namely, from the photosensitive member to the intermediate transfer member-and from the intermediate transfer member to the paper. There arises a difference in transfer efficiency between when the image is transferred through the intermediate transfer member and when the image is directly transferred to the paper from the photosensitive member, thereby causing a difference in image quality between the images formed on both sides of the paper.

The present invention has been conceived to solve the previously described technical drawbacks in the art, the object of which is to provide a double-sided image forming method and apparatus capable of forming images on both sides of recording material with productivity per recording material which is the same as that obtained when an image is formed on one side of the recording material while preventing transfer errors, a distorted image, and the difference in picture quality between the images formed on both sides of the recording material.

As illustrated in FIG. 1A, according to a first aspect of the present invention, there is provided a double-sided image forming method comprising:

a first image primary transfer step A for transferring a first image T1 carried by a first image carrier 1 to a first intermediate transfer member 2;

a second image primary transfer step B for transferring a second image T2 carried by a second image carrier 3 to a second intermediate transfer member 4; and a secondary image transfer step C for secondarily transferring the primarily transferred images T1 and T2 from the respective intermediate transfer members 2 and 4 to both sides of recording material 5, in the area where the first intermediate transfer material 2 and the second intermediate transfer material 4 come into contact with or in proximity to each other.

As illustrated in FIG. 1B, according to a second aspect of the present invention, there is provided a double-sided image forming method comprising the first image primary transfer step A and the second image primary transfer step B which are the same as those employed in the method defined in the first aspect of the present invention.

The method further comprises:

a first image secondary transfer step D for retaining the recording material 5 in a sucked way so as to correspond to the second image T2 formed on the second intermediate transfer material 4 and for secondarily transferring the first transfer image T1 from the first intermediate transfer member 2 to the side of the recording material 5 facing the first intermediate transfer member 2, in the area where the first intermediate transfer material 2 and the second intermediate transfer material 4 come into contact with or in proximity to each other; and a second image secondary transfer step E for secondarily transferring the primarily transferred image T2 from the second intermediate transfer member 4 to the side of the recording material 5 facing the second intermediate transfer member 4 while the recording material 5 is sucked and retained by the second intermediate transfer member 4 after the first image secondary transfer step D.

As illustrated in FIG. 2A, a double-sided image forming apparatus which embodies the double-sided image forming method of the first aspect of the invention, the apparatus comprising:

a first image carrier 1 for carrying a first image T1;

a first intermediate transfer member 2 disposed so as to be opposite to the first image carrier 1;

first intermediate primary transfer means 6 for primarily transferring the first image T1 from the first image carrier 1 to the first intermediate transfer member 2;

a second image carrier 3 for carrying a second image T2;

a second intermediate transfer member 4 disposed so as to be opposite to the second image carrier 3;

second intermediate primary transfer means 7 for primarily transferring the second image T2 from the second image carrier 3 to the second intermediate transfer member 4; and intermediate secondary transfer means 8 for secondarily transferring the primarily transferred images T1 and T2 from the respective intermediate transfer members 2 and 4 to both sides of a recording material 5, in the area where the first intermediate transfer material 2 and the second intermediate transfer material 4 come into contact with or in proximity to each other.

As illustrated in FIG. 2B, a double-sided image forming apparatus which embodies the double-sided image forming method of the second aspect of the invention, comprises the first image carrier 1, the first intermediate transfer member 2, the first intermediate primary transfer means 6, the second image carrier 3, the second intermediate transfer member 4, and the second intermediate primary transfer means 7 which are the same as those provided in FIG. 2A. The double-sided image forming apparatus further comprises:

first intermediate secondary transfer means 9 for retaining the recording material 5 in a sucked way so as to correspond to the second image T2 formed on the second intermediate transfer material 4 and for secondarily transferring the first transfer image T1 from the first intermediate transfer member 2 to the side of the recording material 5 facing the first intermediate transfer member 2, in the area where the first intermediate transfer material 2 and the second intermediate transfer material 4 come into contact with or in proximity to each other; and second intermediate secondary transfer means 10 provided subsequent to the first intermediate secondary transfer means 9 for secondarily-transferring the primarily transferred image T2 from the second intermediate transfer member 4 to the side of the recording material 5 facing the second intermediate transfer member 4 while the recording material 5 is sucked and retained by the second intermediate transfer member 4.

In the previously described technical means, the first and second image carriers 1 and 3 may be formed into any shape (e.g., a drum, a belt, or a combination thereof) so long as they are capable of carrying a monochrome or color images. An image may be formed on the first and second image carriers 1 and 3 by use of various types of method; e.g., the electrophotographic method, the electrostatic transfer method, or the ink-jet method.

The first and second intermediate transfer members 2 and 4 may be formed into any shape such as a belt or a drum, so long as they are capable of temporarily retaining the images T1 and T2 received from the first and second image carriers 1 and 3.

In this event, in terms of assurance of the degree of freedom of layout, it is desirable to form both the first and second intermediate transfer members 2 and 4 in the form of a belt. Alternatively, it is also possible to form one of them in the form of a drum and to form the other one in the form of a belt. Further, so long as they have a certain degree of elasticity in a radial direction, both the first and second intermediate transfer members 2 and 4 may be formed in the form of a drum.

In the double-sided image forming apparatus of the present invention as illustrated in FIG. 2A, the intermediate secondary transfer means 8 may be arranged so as to sequentially and consecutively transfer images to each single side of the recording material 5. In terms of simplification of the transfer device as well as of assurance of prevention of a distorted image, it is desirable to simultaneously transfer images to both sides of the recording material 5.

For example, in a case where the first and second images T1 and T2 are simultaneously transferred to both sides of the recording material 5 by electrophotography, the first and second images T1 and T2 carried by the first and second intermediate transfer members 2 and 4 must be opposite to each other in polarity within the secondary transfer region.

In this case, the first and second images T1 and T2 may be originally formed from materials which are opposite in polarity to each other. Alternatively, polarity inversion means may be provided at a suitable position of the double-sided image forming apparatus in order to reverse the polarity of one of the images.

In order to simultaneously transfer the images to both sides of the recording material 5, the intermediate secondary transfer means 8 may be comprised of; e.g., a pair of transfer members which are disposed so as to be opposite to each other with the first and second intermediate transfer members 2 and 4 sandwiched between them. A transfer bias voltage is applied to one of the transfer members, and the other transfer member is grounded. Alternatively, transfer bias voltages which are opposite in polarity to each other are applied to the respective transfer members.

In this case, although the transfer bias voltages may be directly applied to the transfer members, it is desirable to apply transfer bias voltages to the transfer members via an intermediate member having a uniform surface, such as a contact roller, while it is brought into contact with the transfer members, in order to apply the transfer bias voltages to the entire transfer members uniformly.

In order to consecutively transfer an image to each single side of the recording material 5, the intermediate secondary transfer means 8 may be comprised of; a pair of transfer members for respectively transferring images to the first and second sides of the recording material 5, the transfer members being provided so as to be opposite to each other with the first and second intermediate transfer members 2 and 4 sandwiched between them. The primarily transferred images are secondarily transferred to the first and second sides of the recording material 5 in a consecutive manner by means of these transfer members.

In this case, the transfer-bias voltage may be applied to the transfer members by use of the methods which are the same as those described previously.

The intermediate secondary transfer means 8 performs the retaining and sucking of the recording material 5 and performs secondary transfer of an image to the recording material 5. In terms of further ensured retaining of the recording material 5, sucking means for sucking the recording material 5 may be provided on either the first intermediate transfer member 2 or the second intermediate transfer member 4.

With reference to FIGS. 2A and 2B, in order to form a color image, the first and second intermediate transfer members 2 and 4 carry the color images T1 and T2 which are formed by transferring in multiple image components having a plurality of colors. In order to properly form the color images T1 and T2 without distortion, it is necessary to provide the image forming apparatus with pressing/detaching means. When the recording material 5 passes through a secondary transfer area without transferring the images from the first and second intermediate transfer members 2 and 4 to the recording material 5, the pressing/detaching means separates the first and second intermediate transfer members 2 and 4 from each other. In contrast, when the images are transferred from the first and second intermediate transfer members 2 and 4 to the recording material 5, the pressing/detaching means brings the first and second intermediate transfer members 2 and 4 into contact with or in proximity to each other.

Further, in order to form a color image in a short period of time, the first image carrier 1 and the second image carrier 3 are respectively made up of a group of color image carriers, each of which carries a plurality of image components. The first and second intermediate transfer members 2 and 4 retain and transfer the image components received from the group of color image carriers of the respective first and second image carriers 1 and 3.

The layout of the first and second image carriers 1 and 3 and the first and second intermediate transfer members 2 and 4 is selected, as required. If an emphasis is placed on the stable attitude of the recording material 5 when it enters fixing means, the first and second image carriers 1 and 3 and the first and second intermediate transfer members 2 and 4 are vertically arranged in the secondary transfer area. Fixing means should preferably be provided downstream of the secondary transfer area for fixing unfixed images formed on both sides of the recording material 5.

In FIG. 2A, the intermediate secondary transfer means 8 and the fixing means are usually made of individual devices. In order to use a single device both as the intermediate transfer means 8 and the fixing means, it is only required to pass the first and second intermediate transfer members 2 and 4 around the intermediate transfer means 8, as well as to provide the image forming apparatus with a transfer/fixing member for transferring the images T1 and T2 from the first and second intermediate transfer members 2 and 4 to both sides of the recording material 5 and for fixing the thus-transferred images.

Further, in FIG. 2B, the second intermediate secondary transfer means 10 and the fixing means are usually made of individual devices. In order to use a single device both as the second intermediate secondary transfer means and the fixing means, it is only required to pass the second intermediate transfer member 4 in the form of; e.g., a belt, around the second intermediate secondary transfer means 10, as well as to provide the image forming apparatus with a transfer/fixing member for transferring the second image T2 from the second intermediate transfer member 4 to the second plane of the recording material 5 and for fixing the images T1 and T2 formed on both sides of the recording material 5.

The operation of the aforementioned technical means will be described.

First, in the case of the image forming apparatus as illustrated in FIG. 2A, the first intermediate primary transfer means 6 primarily transfers the first image T1 from the first image carrier 1 to the first intermediate transfer member 2 (the first image primary transfer step A provided in FIG. 1A). The second intermediate primary transfer means 7 primarily transfers the second image T2 from the second image carrier 3 to the second intermediate transfer member 4 (the second image primary transfer step B provided in FIG. 1A).

Subsequently, the intermediate secondary transfer means 8 secondarily transfers the primarily transferred images T1 and T2 from the intermediate transfer members 2 and 4 to both sides of the recording material 5, in the area where the first and second intermediate transfer members 2 and 4 come into contact with or in proximity to each other (the image secondary transfer step C provided in FIG. 1A).

The image forming apparatus, as illustrated in FIG. 2B, performs the first image primary transfer step A and the second image primary transfer step B (see FIG. 1B) which are the same as those previously described.

Then, the first intermediate secondary transfer means 9 sucks and retains the recording material 5 so as to correspond to the second image T2 formed on the second intermediate transfer member 4, in the area where the first and second intermediate transfer members 2 and 4 come into contact with or in proximity to each other. Further, the first intermediate secondary transfer means 9 secondarily transfers the primarily transferred image T1 from the first intermediate transfer member 2 to the side of the recording material 5 facing the fist intermediate transfer member 2 (the first image secondary transfer step D provided in FIG. 1B).

The second intermediate secondary transfer means 10 disposed subsequent to the first intermediate secondary transfer means 9 secondarily transfers the primarily transferred image T2 from the second intermediate transfer member 4 to the side of the recording material 5 facing the second intermediate transfer member 4 while the recording material 5 is sucked and retained by the second intermediate transfer member 4 (the second image secondary transfer step E provided in FIG. 1B).

DETAILED DESCRIPTION OF THE PREFERRED EMBODIMENTS

With reference to embodiments of the present invention illustrated in the accompanying drawings, the present invention will be described in detail.

(FIRST EMBODIMENT)

Figure 1A:
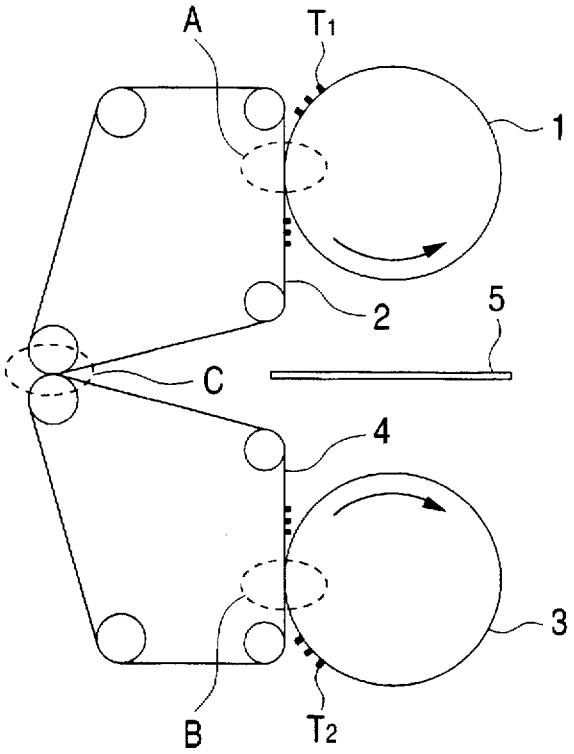
FIGS. 1A and 1B are schematic representations illustrating a double-sided image forming apparatus according to a first embodiment of the present invention.
Figure 1B:
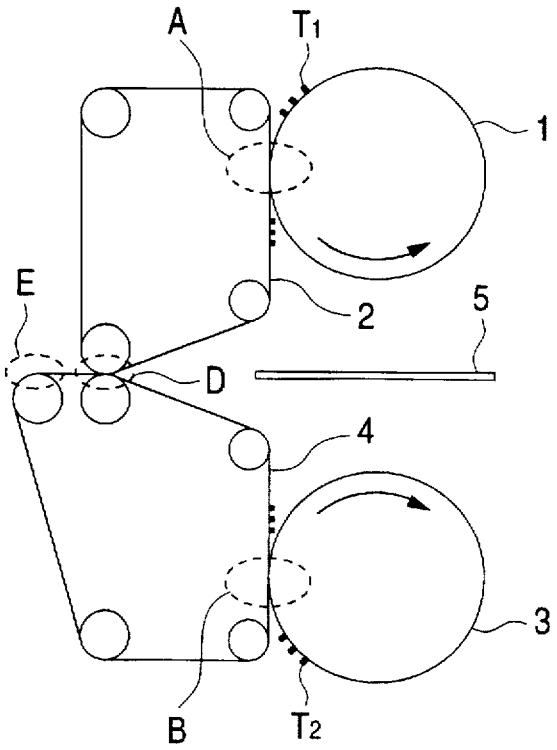
Figure 2A:
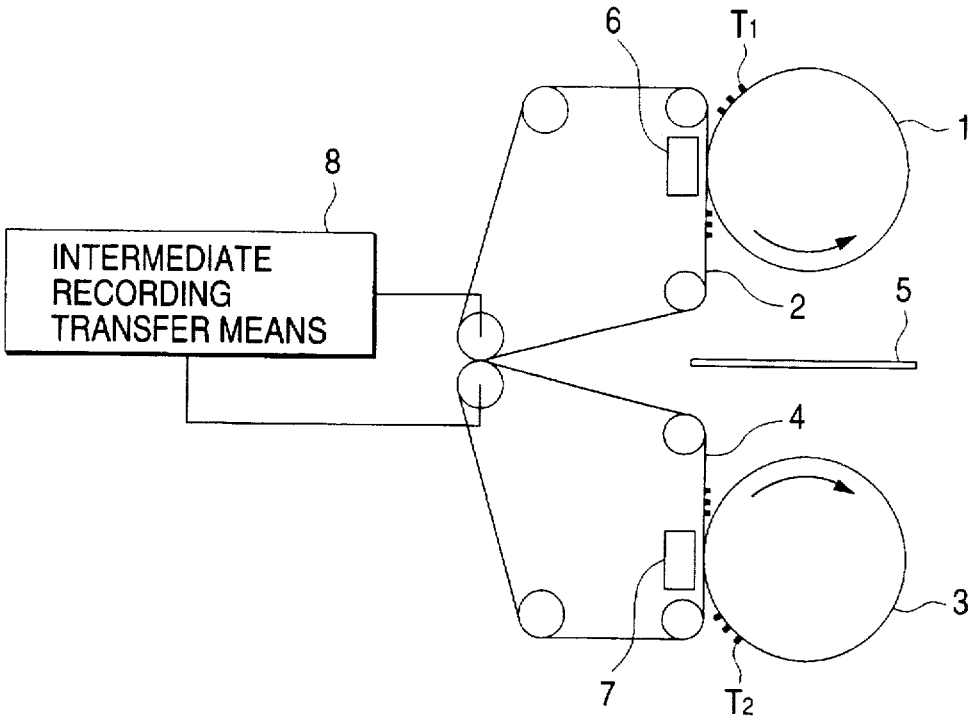
FIGS. 2A and 2B are schematic representations illustrating the details of a secondary transfer section used in the first embodiment.
Figure 2B:
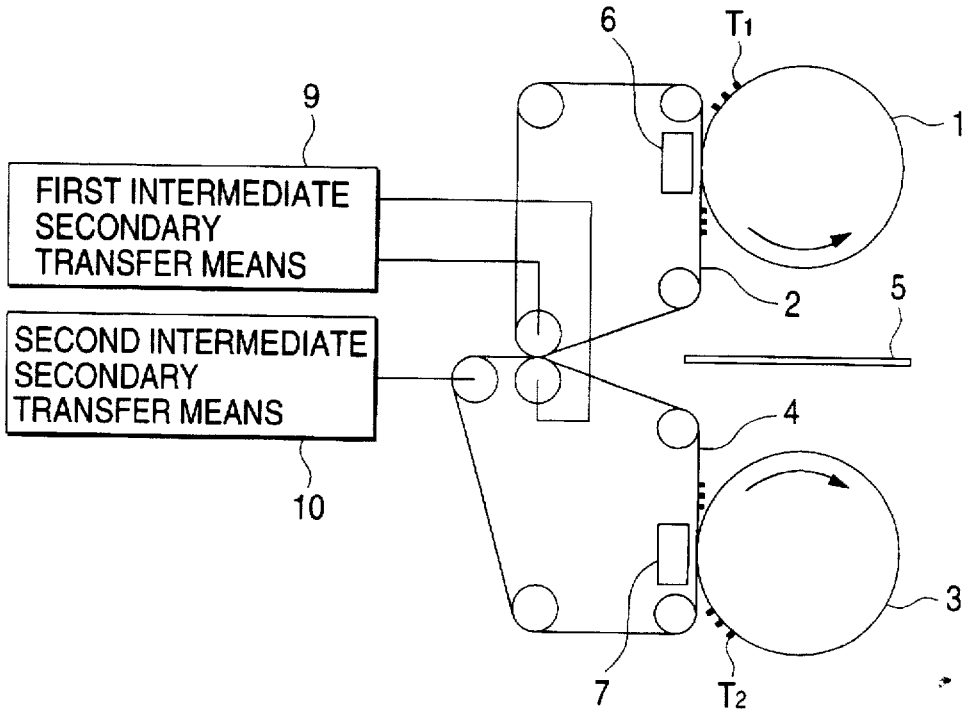
Figure 3:
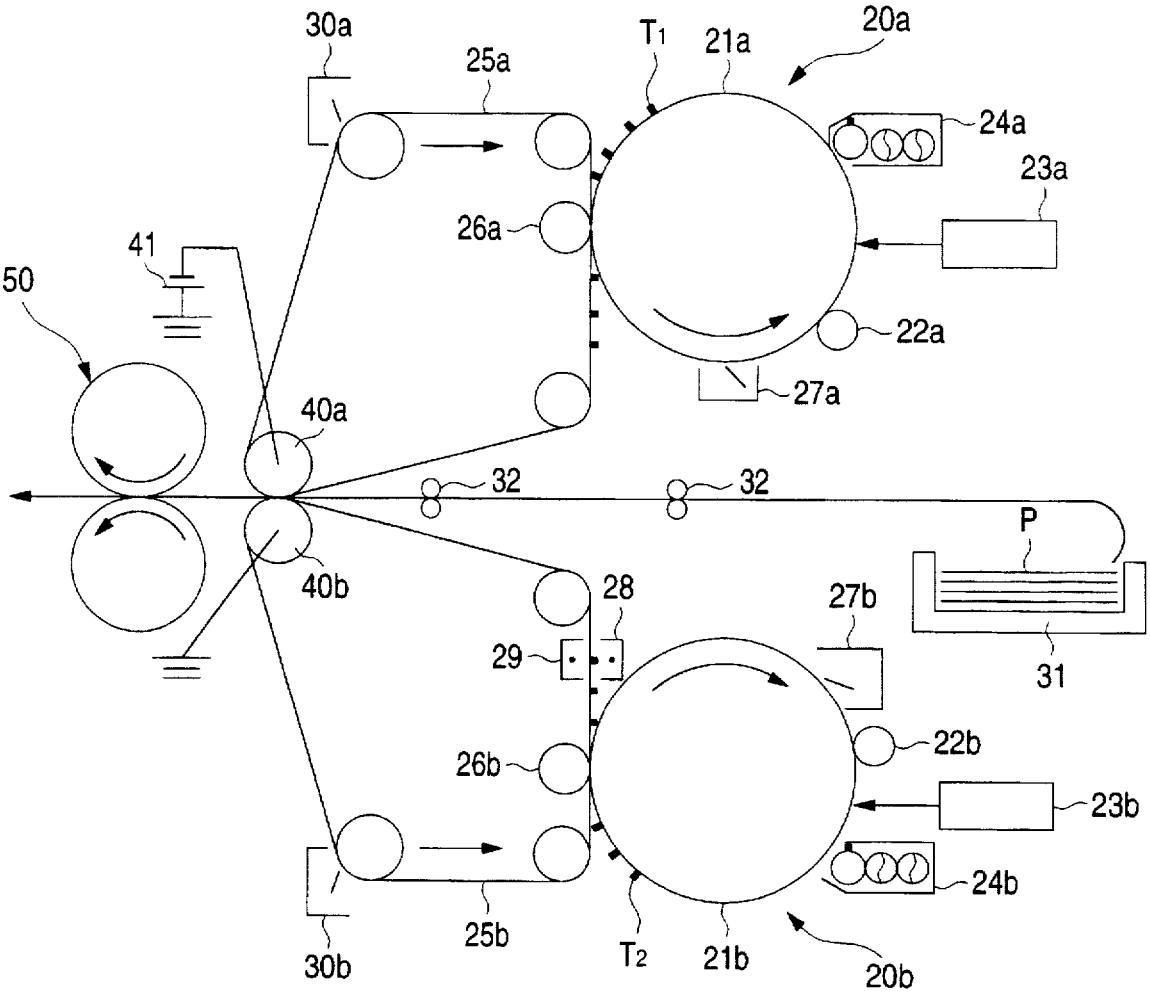
FIG. 3 is a schematic representation illustrating the double-sided image forming apparatus of the first embodiment.

FIG. 3 illustrates the outline of configuration of a first embodiment of a double-sided image forming apparatus to which the present invention is applied.

In the drawing, the double-sided image forming apparatus is comprised of a first image forming section 20*a* for forming a first image on a first plane of paper P; a second image forming section 20*b* for forming a second image on a second plane of the paper P; and a fixing unit 50 for fixing the images formed on the paper P after it has passed through the first and second image forming sections 20*a* and 20*b*.

In the present embodiment, the image forming sections 20*a* and 20*b* are respectively comprised of: photosensitive drums 21*a* and 21*b*, charging rollers 22*a* and 22*b* for electrifying the surface of the photosensitive drums 21*a* and 21*b*, exposure units 23*a* and 23*b* for writing electrostatic latent images for use as the first and second images into the charged photosensitive drums 21*a* and 21*b*, developing units 24*a* and 24*b* for making the latent images written into the photosensitive drums 21*a* and 21*b* visible using toner, intermediate transfer belts 25*a* and 25*b* provided so as to be in contact with the photosensitive drums 21*a* and 21*b*, primary transfer rollers 26*a* and 26*b* for primarily transferring the toner images T1 and T2 (for example, positive images in the present embodiment) from the photosensitive drums 21*a* and 21*b* to the intermediate transfer belts 25*a* and 25*b*, and cleaners 27*a* and 27*b* for eliminating residual toner from the photosensitive drums 21*a* and 21*b*.

A pair of polarity-reversing corotrons 28 and 29 are disposed so as to face each other with the intermediate transfer belt 25*b* sandwiched between them in a downstream direction with reference to the primary transfer position of the intermediate transfer belt 25*b* of the second image forming section 20*b*.

In the present embodiment, the intermediate transfer belts 25*a* and 25*b* are wrapped around a required number of retaining rollers (one of them is a-drive roller, and the other rollers are driven rollers) and are arranged so as to rotate in synchronization with the photosensitive drums 21*a* and 21*b*. Reference numerals 30*a* and 30*b* are belt cleaners for eliminating residual toner from the intermediate transfer belts 25*a* and 25*b*.

The intermediate transfer belts 25*a* and 25*b* are made of resin such as polyimide, acrylic resin, polyvinylchloride, polyester, polycarbonate, or polyethylene terephthalate (PET), or various types of rubber together with a required content of an anti-static agent such as carbon black. The intermediate transfer belts are formed so as to have a volume resistivity of $10^9$ to $10^{14}$ Ω·C The thickness of the belt is set to; e.g., 0.08 mm.

The retaining rollers disposed in the area where the intermediate transfer belts 25*a* and 25*b* come into contact with or in proximity to each other, are made up of secondary transfer rollers 40*a* and 40*b*.

The secondary transfer rollers 40*a* and 40*b* may perform transferring operations even if they are conductive. However, if images are transferred to small-sized paper, an excessively large current flow between the secondary transfer rollers 40*a* and 40*b* as a result of direct contact between the first and second intermediate transfer belts 25*a* and 25*b*. As a result, a sufficient transfer electric field cannot be formed, which in turn results in transfer errors. Since the intermediate transfer belts 25*a* and 25*b* are apt to become damaged, it desirable to use a conductive roller coated with a semi-conductive or insulating material for at least the roller that receives an applied bias voltage.

In the present embodiment, as the secondary transfer rollers 40*a* and 40*b*, there are used a roller made of a metal shaft coated with EPDM rubber which includes dispersed carbon black and is formed so as to have a volume resistivity of $10^5$ Ω·cm. Transfer bias 41 is applied to the shaft of the secondary transfer roller 40*a*, whereas the shaft of the secondary transfer roller 40*b* is grounded.

As another coating material, there may be used polyurethane or silicon rubber which includes dispersed conductive particles (carbon black or aluminum etc.,) or ion conductive material ($LiClO_4$ etc.). It is desirable to set the volume resistivity of such a coating material to $10^5$ to $10^9$ Ω·cm.

In the present embodiment, negatively charged toner is used for toner T1 and T2. DC+10 μA is applied to the primary transfer rollers 26*a* and 26*b*. AC 8 kVp-p/600 Hz having DC +1 kV superimposed thereon is applied to the polarity-reversing corotron 28, and AC 8 kVp-p/600 Hz having DC −1 kV superimposed thereon is applied to the polarity-reversing corotron 29. Further, DC −2 kV is applied to the secondary transfer roller 40*a*.

The outer diameter of the first and second photosensitive drums 21*a* and 21*b* and the circumferential length of the first and second intermediate transfer belts 25*a* and 25*b* are set to an identical length.

The distance between the secondary transfer position and the fixing unit 50 is set so as to become smaller than the length of the paper having the minimum size. The speed of rotation of the fixing rollers is set so as to become equal to or slightly slower than the speed of the intermediate transfer belts 25*a* and 25*b*.

Further, the upper and lower fixing rollers of the fixing unit 50 are formed into an identical shape so that a fixing nip becomes linear, and heaters are housed in the respective fixing rollers.

In FIG. 3, reference numeral 31 designates a paper tray; and 32 designates a conveyor roller for conveying the paper P.

Next, the imaging process of the double-sided image forming apparatus according to the present invention will be described.

The first toner image T1 formed on the first photosensitive drum 21*a* is transferred to the first intermediate transfer belt 25*a* which travels substantially at the same speed as that at which the first photosensitive drum 21*a* travels, by means of the primary transfer roller 26*a*.

Similarly, at the same timing at which the image is transferred from the first photosensitive drum 21*a*, the second toner image T2 formed on the second photosensitive drum 21*b* is transferred to the second intermediate transfer belt 25*b* by means of the primary transfer roller 26*b*. The polarity of the second toner image T2 is reversed by application of a voltage to the polarity-reversing corotrons 28 and 29 which are provided so as to be opposite to each other with the second intermediate transfer belt 25*b* sandwiched between them.

The paper P is conveyed at appropriate timing from the paper tray 31 between the secondary transfer rollers 40*a* and 40*b*. After the toner images T1 and T2 have been simultaneously transferred from the intermediate transfer belts 25*a* and 25*b* to the paper P, they are fixed on the paper by the fixing unit 50 at the same time.

Figure 4:
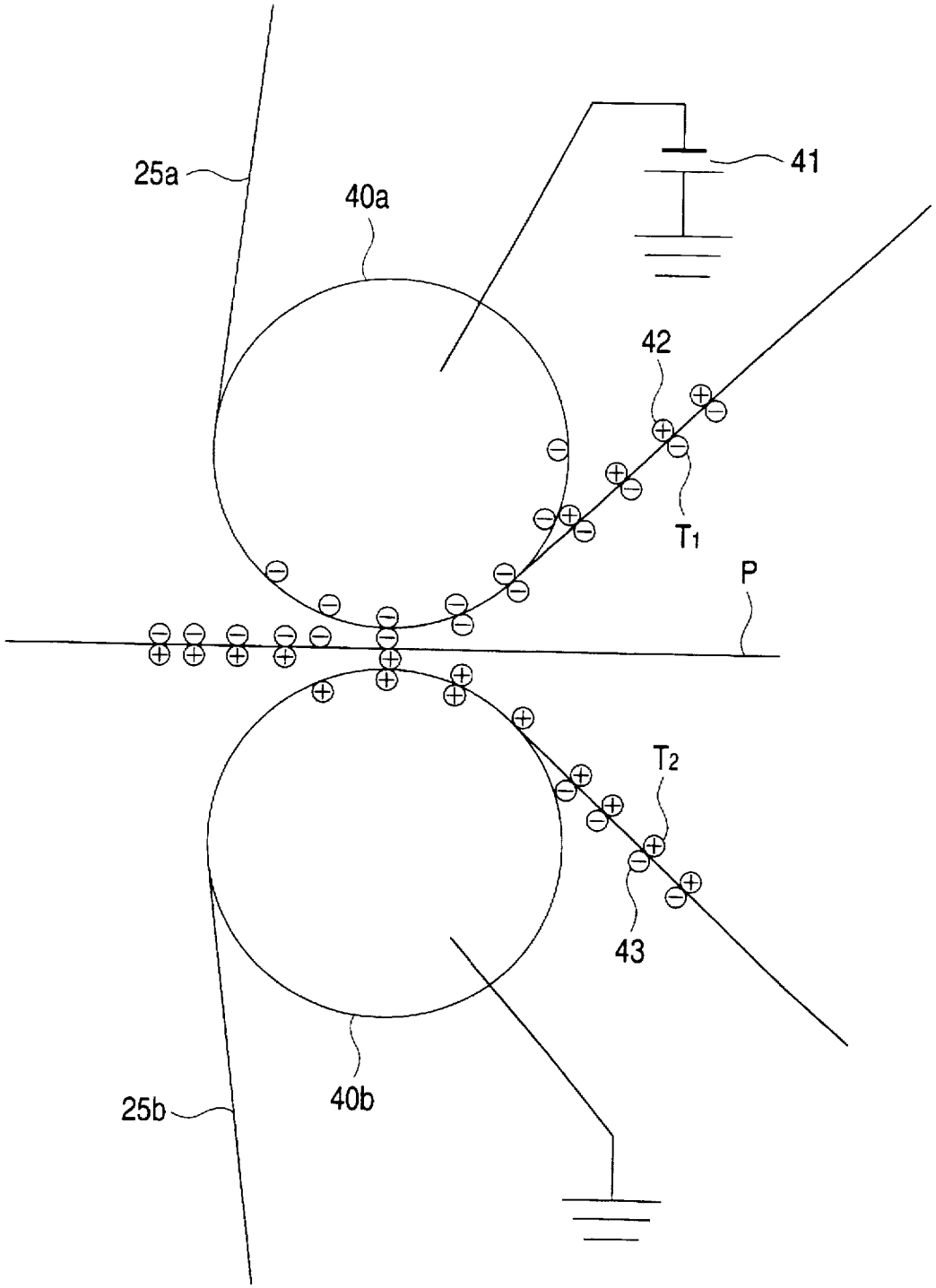
FIG. 4 is a schematic representation illustrating the details of the secondary transfer section used in the first embodiment.

The principle of secondary transfer of an image will be described in detail upon reference chiefly to FIG. 4.

The bias voltage 41 having a negative polarity is applied to the secondary transfer roller 40*a*, so that positive charges 42 on the reverse side of the intermediate transfer belt 25*a* are canceled. As a result of homopolar repulsive force, the toner image T1 having a negative polarity is transferred from the intermediate transfer belt to the paper P.

In contrast, the secondary transfer roller 40*b* is grounded, so that negative charges 43 on the reverse side of the intermediate transfer belt 25*b* are canceled. The toner image T2 formed on the second intermediate transfer belt 25*b* whose polarity has been reversed to a positive polarity by the polarity-reversing corotrons 28 and 29, is transferred to the paper P by attraction of the secondary transfer roller 40*a*. In this way, images can be simultaneously transferred to both sides of the paper P.

In a case where an image is formed on one side of the paper, it is possible to prevent the reverse side of the paper from being stained by application of a bias voltage having the polarity opposite to that of the ordinary transfer bias voltage, to the primary transfer roller 26*a* or 26*b*. In addition, it is also possible to switch a bias voltage for developing purposes or to separate the photosensitive drums 21*a* and 21*b* from the intermediate transfer belts 25*a* and 25*b*.

As has been described above, the toner images T1 and T2 are transferred from the photosensitive drums 21*a* and 21*b* to the intermediate transfer belts 25*a* and 25*b*. Then, the paper P travels between the secondary transfer rollers 40*a* and 40*b* and is further transported to the fixing unit 50. Thereby, the images on both sides of the paper P are simultaneously fixed. As a result, the images can be formed on both sides of a sheet of paper without distortion at the same speed as that at which an image is formed on one side of the paper.

The outer diameters of the first and second photosensitive drums 21*a* and 21*b* and the circumferential length of the first and second intermediate transfer belts 25*a* and 25*b* is set to an identical length. Images are formed on the photosensitive drums 21*a* and 21*b* at the same timing, whereby the images formed on both sides of the paper can be accurately placed in alignment with each other.

Although the bias rollers are used as the transfer devices 26*a*, 26*b*, and 40*a* in the present embodiment, corotrons may be used instead of them.

Further, although the toner having the same charging polarity is used in the present embodiment, and the polarity of the toner image T2 is reversed by the second internal transfer belt 25*b*, the polarity of the same may be reversed on the photosensitive drum 21*b*. Further, toner having the opposite charging polarities may be used.

Furthermore, although the transfer bias voltage is applied to one of the secondary transfer rollers 40*a*, and the other secondary transfer roller 40*b* is grounded in the present embodiment, transfer bias voltages which are opposite in polarity to each other may be applied to the secondary transfer rollers 40*a* and 40*b*.

These changes in design may be employed in the following embodiments, which will be described below, as required.

(SECOND EMBODIMENT)

Figure 5:
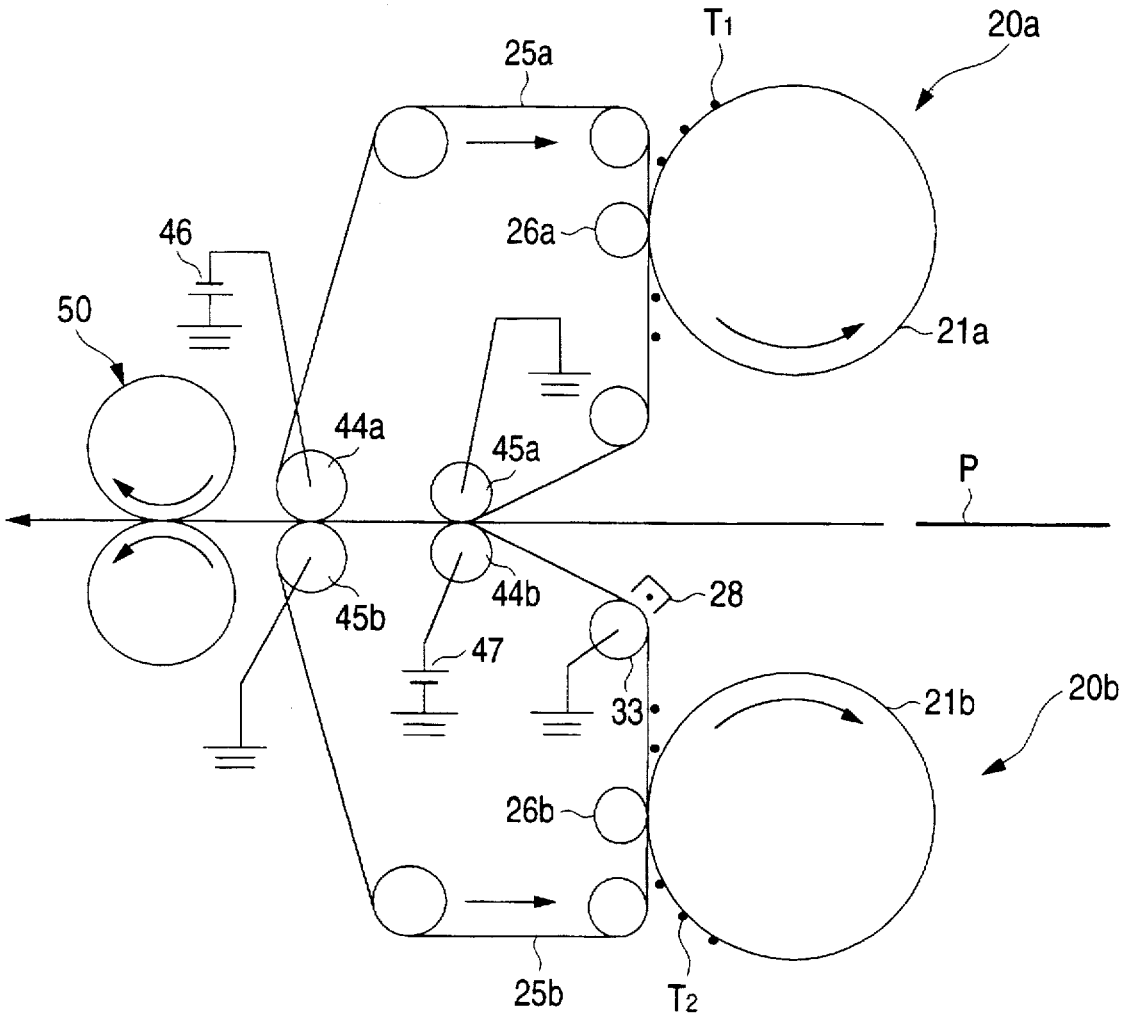
FIG. 5 is a schematic representation illustrating a double-sided image forming apparatus of a second embodiment.

FIG. 5 illustrates the outline of configuration of the double-sided image forming apparatus to which the present invention is applied.

In the drawing, the double-sided image forming apparatus of the second embodiment is substantially the same in essential configuration as the double-sided image forming apparatus of the first embodiment. The second embodiment is different from the first embodiment in the following points:

Two pairs of rollers a pair of secondary transfer rollers 44*a* and 44*b* which receive bias voltages 46 and 47 and a pair of back-up rollers 45*a* and 45*b* are provided in the secondary transfer section where the first and second intermediate transfer belts 25*a* and 25*b* come into contact with or in proximity to each other. Further, the polarity-reversing corotron 28 is disposed opposite a tension roller 33 which is one of the rollers retaining the intermediate transfer belt 25*b*. The constituent elements which are the same as those used in the first embodiment will be assigned the same reference numerals, and their detailed explanations will be omitted here. In the second embodiment, the devices disposed around the photosensitive drums 21*a* and 21*b* will be omitted. The same applies to the following embodiments.

In the second embodiment, negatively-charged toner is used for the toner images T1 and T2. DC +10 μA is applied to the primary transfer rollers 26*a* and 26*b*, and AC 8 kVp-p/600 Hz having DC +500 V superimposed thereon is applied to the polarity-reversing corotrons 28 and 29. Further, DC −2 kV and +2 kV are applied to the secondary transfer rollers 44*a* and 44*b* respectively. The tension roller 33 and the back-up rollers 45*a* and 45*b* are grounded.

The imaging process of the double-sided image forming apparatus of the second embodiment will be described.

As in the first embodiment, the first and second toner images T1 and T2 are transferred to the first and second intermediate transfer belts 25*a* and 25*b* from the photosensitive drums 21*a* and 21*b*. The polarity of the second toner image T2 formed on the second intermediate transfer belt 25*b* is reversed by grounding the tension roller 33, and by applying a voltage to the polarity-reversing corotron 28.

The paper P is conveyed to the secondary transfer section. In a consecutive manner, the first toner image T1 is transferred to the paper P mainly between the secondary transfer roller 44*b* and the back-up roller 45*a*, and the second toner image T2 is transferred to the paper P chiefly between the secondary transfer roller 44*a* and the back-up roller 45*b*. The paper having images transferred to both sides thereof are simultaneously fixed on the paper by the fixing unit 50.

In the secondary transfer section, the first toner image T1 is transferred to one side of the paper P by means of the electric field developed between the secondary transfer roller 44*b* and the back-up roller 45*a*. The second toner image T2 is transferred to the other side of the paper P by means of the electric field developed between the secondary transfer roller 44*a* and the back-up roller 45*b*. As a result, it becomes feasible to control each of the transfer electric fields, which in turn enables accurate transfer of images on both sides of the paper P.

Images are continuously transferred to the paper through the nip between the intermediate transfer belts 25*a* and 25*b*, thereby making it possible to prevent an image from being distorted.

As has been described above, the toner images T1 and T2 are transferred to the intermediate transfer belts 25*a* and 25*b* from the photosensitive drums 21*a* and 21*b*, respectively. The paper P is conveyed between the intermediate transfer belts 25*a* and 25*b*. The images are continuously transferred to the respective sides of the paper P from the intermediate transfer belts 25*a* and 25*b* by means of the electric fields developed between the secondary transfer rollers 44*a* and 44*b* and the back-up rollers 45*a* and 45*b*. The paper P is transferred to the fixing unit 50 as it is, and the images provided on both sides of the paper are simultaneously fixed. As a result, the images can be formed on both sides of the paper without distortion at the same speed as that at which an image is formed on one side of the paper.

(THIRD EMBODIMENT)

Figure 6:
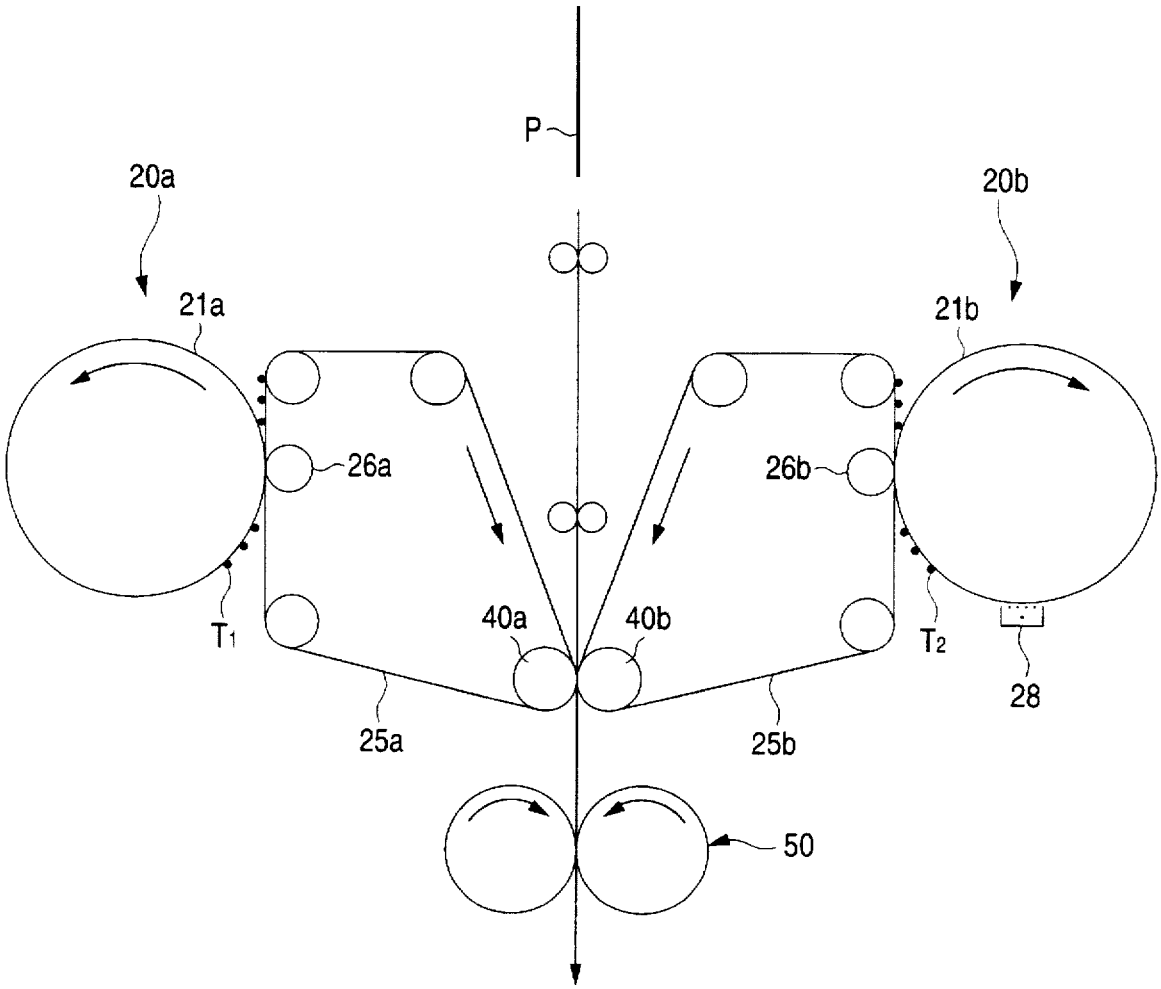
FIG. 6 is a schematic representation illustrating a double-sided image forming apparatus of a third embodiment.

FIG. 6 illustrates the outline of configuration of the double-sided image forming apparatus of the third embodiment to which the present invention is applied.

In the drawing, the double-sided image forming apparatus of the third embodiment is substantially the same in essential configuration as the double-sided image forming apparatus of the first embodiment. The third embodiment is different from the first embodiment in the following points:

The paper transfer path is defined in a vertical direction, and the fixing unit 50 is disposed below the secondary transfer section in which the intermediate transfer belts 25*a* and 25*b* come into contact with or in proximity to each other. The polarity-reversing corotron 28 is disposed opposite the second photosensitive drum 21*b*.

In the third embodiment, negatively-charged toner is used for the toner images T1 and T2. DC +10 μA and −10 μA are applied to the primary transfer rollers 26*a* and 26*b*, respectively. DC +250 μA and a grid voltage +500 V are applied to the polarity-reversing corotron 28. Further, DC −1 kV and +1 kV are applied to the secondary transfer rollers 40*a* and 40*b* respectively.

The imaging process of the double-sided image forming apparatus of the third embodiment will be described.

The first toner image T1 formed on the first photosensitive drum 21*a* is transferred to the first intermediate transfer belt 25*a* by means of the first transfer roller 26*a*.

Similarly, the polarity of the second toner image T2 that is formed on the second photosensitive drum 21*b* at the same timing at which the first toner image T1 is formed on the first photosensitive drum 21, is reversed by applying a voltage to the polarity-reversing corotron 28. The second toner image T2 is transferred to the second intermediate transfer belt 25*b* by means of the first transfer roller 26*b*.

The paper P is conveyed between the second transfer rollers 40*a* and 40*b* at appropriate timing. After the toner images T1 and T2 have been simultaneously transferred to the paper P from the intermediate transfer belts 25*a* and 25*b*, the images are concurrently fixed on the paper by the fixing unit 50.

As has been described above, the toner images T1 and T2 are transferred to the intermediate transfer belts 25*a* and 25*b* from the photosensitive drums 21*a* and 21*b*, respectively. The paper P is conveyed between the intermediate transfer belts 25*a* and 25*b*. The images are continuously transferred to the respective sides of the paper P from the intermediate transfer belts 25*a* and 25*b* by means of the electric fields developed between the secondary transfer rollers 40*a* and 40*b*. The paper P is transferred to the fixing unit 50 as it is, and the images provided on both sides of the paper are simultaneously fixed. As a result, the images can be formed on both sides of the paper without distortion at the same speed as that at which an image is formed on one side of the paper.

Particularly, in the third embodiment, the attitude of the paper P becomes stable after having passed through the second transfer section as a result of transfer of the paper in a vertical direction. Since the attitude of the paper when entering the fixing unit 50 becomes stable, it becomes possible to prevent paper from becoming crumpled and to prevent an image from being distorted.

(FOURTH EMBODIMENT)

Figure 7:
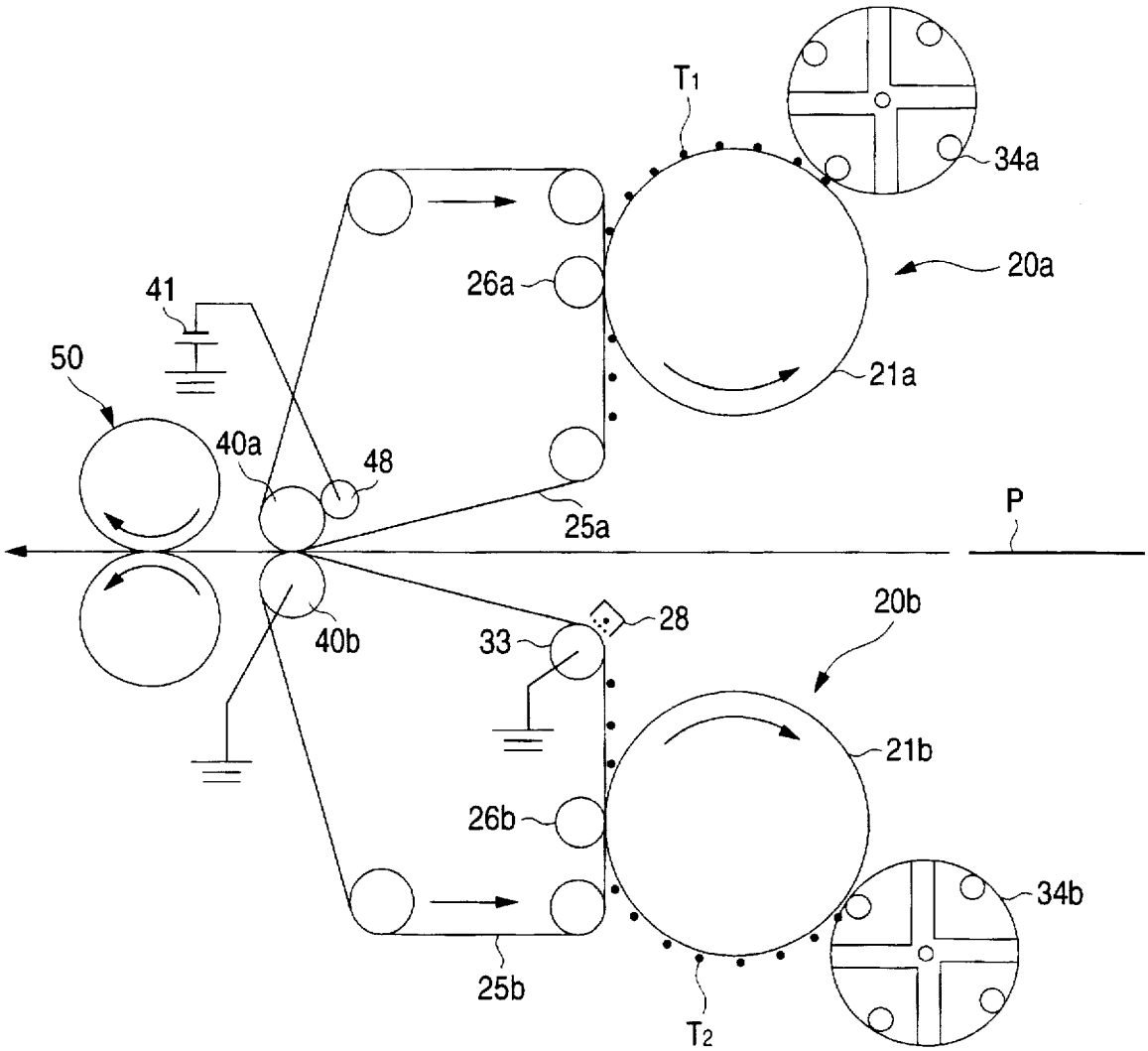
FIG. 7 is a schematic representation illustrating a double-sided image forming apparatus of a fourth embodiment.

FIG. 7 illustrates the outline of configuration of the double-sided image forming apparatus to which the present invention is applied.

In the drawing, the double-sided image forming apparatus of the fourth embodiment is substantially the same in essential configuration as the double-sided image forming apparatus of the first embodiment. The fourth embodiment is different from the first embodiment in the following points:

The double-sided image forming apparatus is provided with rotary developing units 34*a* and 34*b* for full-color purposes [i.e., yellow (Y), magenta (M), cyan (C), and black (K) in the fourth embodiment]. A contact roller 48 which is in contact with the secondary transfer roller 40*a* is provided to apply a bias voltage to the secondary transfer roller 40*a*. Further, a pressing/detaching mechanism 70 (see FIG. 8) is provided between the secondary rollers 40*a* and 40*b*.

In the fourth embodiment, the secondary roller 40*a* is made up of a metal shaft coated with insulating EPDM rubber, and a thin layer of conductive EPDM rubber covering the insulating EPDM rubber. The surface resistance of the thin layer of conductive EPDM rubber is set to $10^9/cm^2$. The contact roller 48 is made up of a metal shaft. The secondary transfer roller 40*b* is made up of a metal shaft, and EPDM rubber having carbon black dispersed therein. The volume resistivity of the EPDM rubber is set to $10^5$ Ω·cm.

Various types of rubber and resin having a volume resistivity of more than $10^{11}$ Ω·cm can be used as the insulating layer. In addition to the thin layer of conductive EPDM rubber, PVdF, polyester, or an acrylic substance having conductive particles such as carbon black dispersed therein, can be used as the conductive thin layer. It is desirable to set the surface resistance of the conductive thin layer to $10^8$–$10^{10}$ Ω/cm$^2$.

Figure 8:
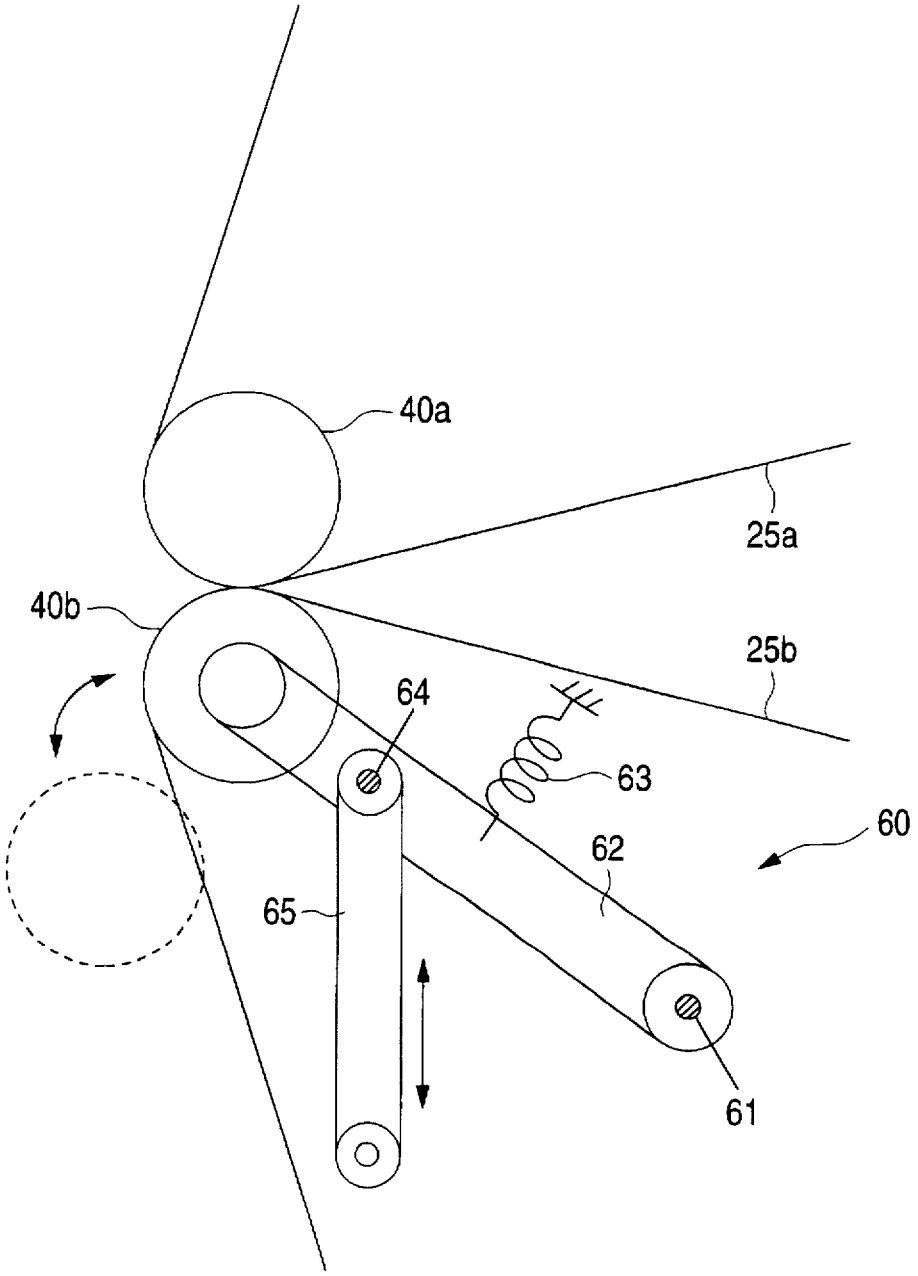
FIG. 8 is a schematic representation illustrating the details of a pressing/detaching mechanism of the secondary transfer section used in the fourth embodiment.

With reference to FIG. 8, the pressing/detaching mechanism 60 provided between the secondary transfer rollers 40*a* and 40*b* will be described.

In the fourth embodiment, the first secondary transfer roller 40*a* is fixed, and the second secondary transfer roller 40*b* is movable.

The secondary transfer roller 40*b* is retained by a lever 62 so as to be pivotal on a pivot 61, and the lever 62 is supported by a spring 63. The secondary transfer roller 40*b* travels by moving a lever 65 jointed to the lever 62 via a fulcrum 64, thereby bringing the secondary transfer rollers 40*a* and 40*b* in or out of contact with each other.

Further, in the fourth embodiment, negatively-charged toner is used for the toner images T1 and T2. DC +10 μA is applied to the primary transfer rollers 26*a* and 26*b* every time the image is transferred in each of YMCK colors. DC +300 μA and a grid voltage +500 V are applied to the polarity-reversing corotron 28. Further, DC −2 kV is applied to the contact roller 48 that is in contact with the secondary transfer roller 40*a*, and the secondary transfer roller 40*b* is grounded.

The circumferential length of the intermediate transfer belts 25*a* and 25*b* is set so as to become twice as long as the circumferential length of the photosensitive drums 21*a* and 21*b*. To prevent color misregistration, it is desirable to set the circumferential length of the photosensitive drums 21*a* and 21*b* to an integral multiple of the circumferential length of the photosensitive drums 21*a* and 21*b*.

The imaging process of the double-sided image forming apparatus of the fourth embodiment will be described.

While the secondary transfer rollers 40*a* and 40*b* are separated from each other, the first toner images T1 are formed on the first photosensitive drum 21*a* in order of YMCK and are sequentially transferred to the first intermediate transfer belt 25*a* by means of the primary transfer roller 26*a* in such a way that the toner image T1 of single color is transferred every time the intermediate transfer belt rotates. Similarly, the second toner images T2 (of YMCK colors) formed on the second photosensitive drum 21*b* are sequentially transferred to the secondary transfer belt 25*b* by means of the primary transfer roller 26*b*. Then, the polarity of the second toner image T2 is reversed by applying a voltage to the polarity-reversing corotron 28 disposed opposite the grounded tension roller 33.

After the toner images T1 and T2 of the third color; i.e., cyan, transferred to the intermediate transfer belts 25*a* and 25*b* have passed the secondary transfer section, the secondary transfer rollers 40*a* and 40*b* are brought into contact with each other. The paper P is conveyed at appropriate timing, the toner images T1 and T2 formed on the intermediate transfer belts 25*a* and 25 are simultaneously transferred to the paper P. Then, the toner images T1 and T2 are simultaneously fixed on the paper by the fixing unit 50.

As has been described, the toner images T1 and T2 of YMCK colors are transferred to the intermediate transfer belts 25*a* and 25*b* from the photosensitive drums 21*a* and 21*b* in a superimposed manner. The paper P is conveyed between the intermediate transfer belts 25*a* and 25*b*, and the images formed on the intermediate transfer belts 25*a* and 25*b* are simultaneously transferred to the respective sides of the paper P by means of the electric field developed between the secondary transfer rollers 40*a* and 40*b*. The paper P is horizontally conveyed to the fixing unit 50 as it is, whereby the images formed on both sides of the paper P are concurrently fixed. As a result, color images can be formed on both sides of the paper without distortion at the same speed as that at which an image is formed on one side of the paper.

(FIFTH EMBODIMENT)

Figure 9:
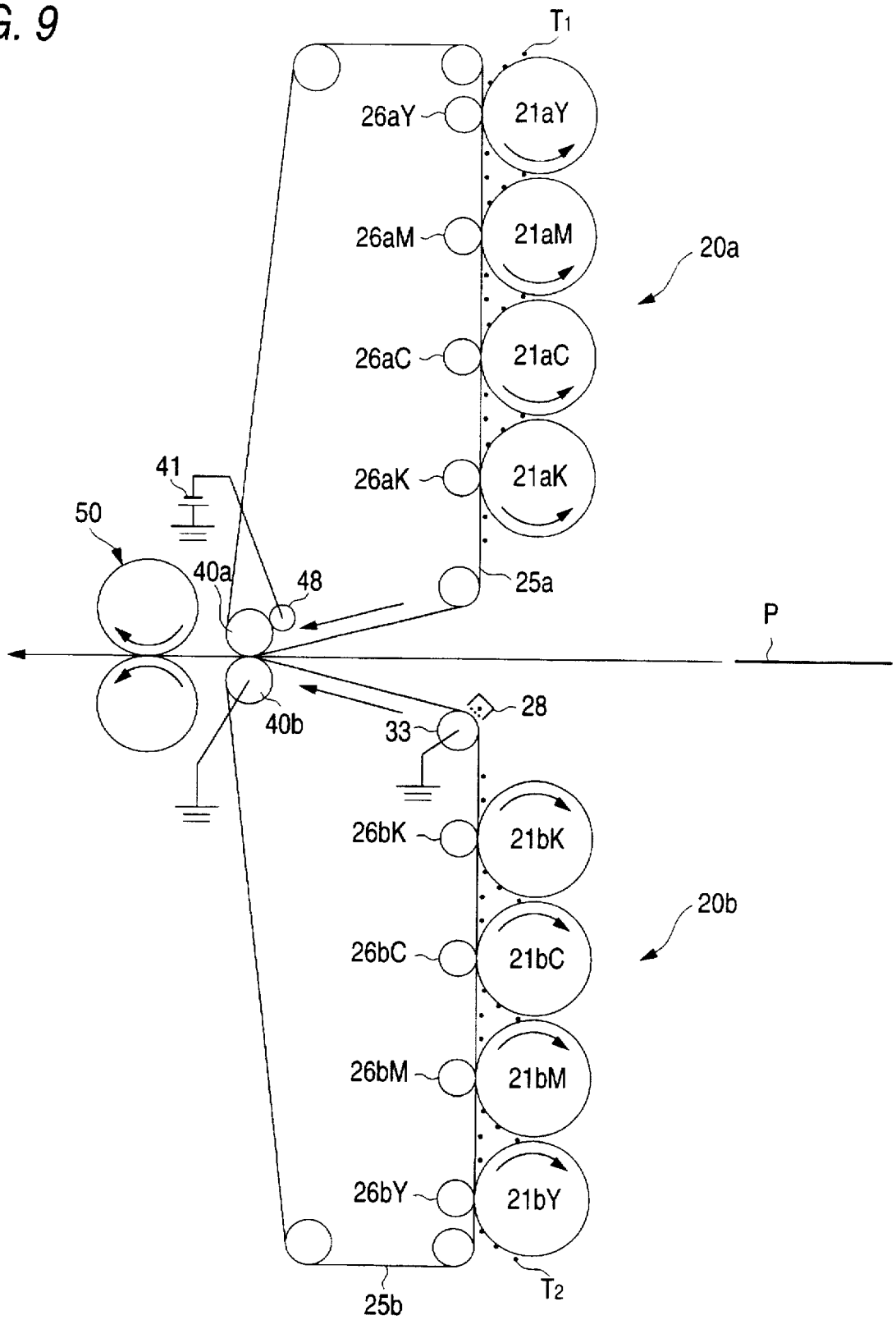
FIG. 9 is a schematic representation illustrating a double-sided image forming apparatus of a fifth embodiment.

FIG. 9 illustrates the outline of configuration of the double-sided image forming apparatus of a fifth embodiment to which the present invention is applied. In the drawing, the double-sided image forming apparatus of the fifth embodiment is substantially the same in essential configuration as the double-sided image forming apparatus of the fourth embodiment. The fifth embodiment is different from the fourth embodiment in the following points:

The double-sided image forming apparatus is provided with a first photosensitive drum group 21*a* for forming toner images in YMCK colors (more specifically, comprising drums 21*a*Y, 21*a*M, 21*a*C, and 21*a*K), a second photosensitive drum group 21*b* (more specifically, comprising drums 21*b*Y, 21*b*M, 21*b*C, and 21*b*K), and primary transfer rollers 26*a* corresponding to the drum groups (more specifically, the primary transfer rollers comprise 26*a*Y, 26*a*M, 26*a*C, 26*a*K, 26*b*Y, 26*b*M, 26*b*C, and 26*b*K).

In the fifth embodiment, negatively-charged toner is used for the toner images T1 and T2. DC +10 gA is applied to the primary transfer rollers 26*a*Y to 26*a*K and 26*b*Y to 26*b*K, respectively. Every time the toner image T1 is formed in each of YMCK colors, DC +300 μA and a grid voltage +500 V are applied to the polarity-reversing corotron 28. DC −2 kV is applied to the contact roller 48 which is in contact with the secondary transfer rollers 40*a*. The secondary transfer roller 40*b* is grounded.

The imaging process of the double-sided image forming apparatus of the fifth embodiment will be described.

The first toner images T1 are consecutively transferred in order of YMCK from the first photosensitive drum group 21*a*; namely, 21*a*Y, 21*a*M, 21*a*C, and 21*a*K, to the first intermediate transfer belt 25*a* by means of the first transfer rollers 26*a*Y, 26*a*M, 26*a*C, and 26*a*K.

Similarly, the second toner images T2 (of YMCK colors) are transferred from the second photosensitive drum group 21*b*; namely, 21*b*Y, 21*b*M, 21*b*C, and 21*b*K, to the second intermediate transfer belt 25*b* by means of the primary transfer rollers 26*b*Y, 26*b*M, 26*b*C, and 26*b*K. The polarity of the second toner image T2 is reversed by applying a voltage to the polarity-reversing corotron 28 disposed opposite the grounded tension roller 33.

The paper P is transferred at appropriate timing, and the toner images T1 and T2 are simultaneously transferred to the paper P from the intermediate transfer belts 25*a* and 25*b*. The images are simultaneously fixed on the respective sides of the paper by the fixing unit 50.

As has been described above, the toner images T1 and T2 are transferred from the photosensitive drum groups 21*a* (21*a*Y to 21*a*K) and 21*b* (21*b*Y to 21*b*K) to the intermediate transfer belts 25*a* and 25*b* in a superimposed manner. The paper P is transferred between the intermediate transfer belts 25*a* and 25*b*, so that the toner images T1 and T2 are concurrently transferred to the respective sides of the paper P by means of the electric field developed between the secondary transfer rollers 40*a* and 40*b*. The paper P is horizontally conveyed to the fixing unit 50 as it is, and the images are concurrently fixed on the respective sides of the paper. As a result, color images can be formed on both sides of the paper without distortion at the same speed as that at which an image is formed on one side of the paper.

(SIXTH EMBODIMENT)

Figure 10:
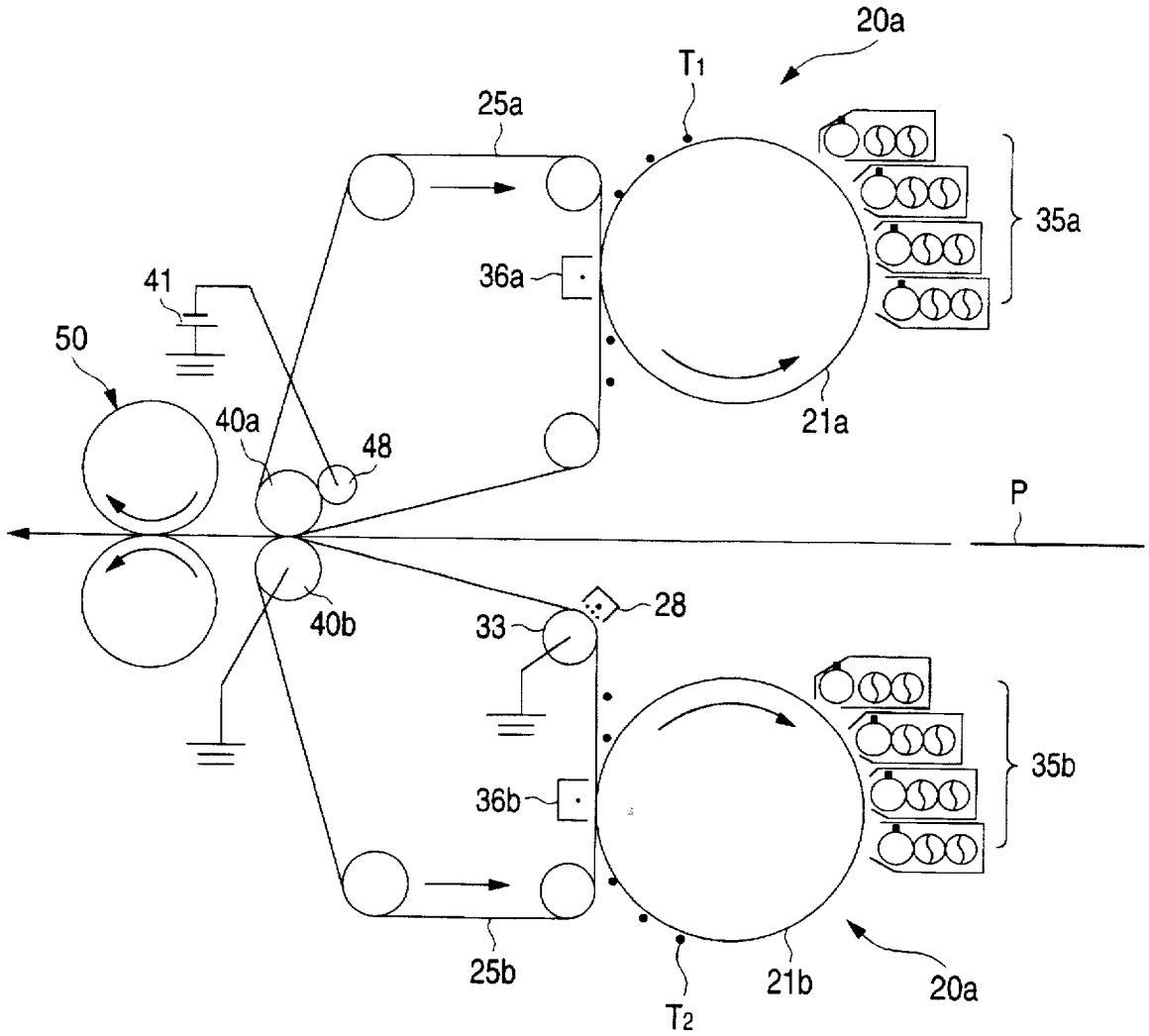
FIG. 10 is a schematic representation illustrating a double-sided image forming apparatus of a sixth embodiment.

FIG. 10 illustrates the outline of configuration of the double-sided image forming apparatus according to a sixth embodiment of the present invention.

In the drawing, the double-sided image forming apparatus of the sixth embodiment is substantially the same in essential configuration as the double-sided image forming apparatus of the fourth embodiment. The sixth embodiment is different from the fourth embodiment in the following points:

The double-sided image forming apparatus is provided with first and second developing unit groups 35*a* and 35*b* for developing toner images of YMCK colors. Further, first and second primary transfer corotrons 36*a* and 36*b* are used as the primary transfer devices.

In the sixth embodiment, negatively-charged toner is used for the toner images T1 and T2. DC +300 μA is applied to the primary transfer rollers 36*a* and 36*b*. DC +300 μA and a grid voltage of +500 V are applied to the polarity-reversing corotron 28, and DC −2 kV is applied to the contact roller 48 which is in contact with the secondary transfer roller 40*a*. The secondary transfer roller 40*b* is grounded.

The imaging process of the double-sided image forming apparatus of the sixth embodiment will be described.

The toner images T1 of YMCK colors are formed in multiple on the first photosensitive drum 21*a* during one rotation of the first photosensitive drum 21*a* by means of the first developing unit group 35*a* and of charging and exposure devices (not shown) provided between the units of the first developing unit group 35*a*. The thus-formed toner images are transferred to the first intermediate transfer belt 25*a* by the primary transfer corotron 36*a*.

Similarly, the toner images T2 formed on the second photosensitive drum 21*b* by means of the second developing unit group 35*b* and of charging and exposure devices (not shown) provided between the units of the second developing unit group. The thus-formed toner images T2 are then transferred to the second intermediate transfer belt 25*b* by the primary transfer corotron 36*b*. The polarity of the second toner images T2 is reversed by applying a voltage to the polarity-reversing corotron 28 disposed opposite the grounded tension roller 33.

The paper P is transferred at appropriate timing, and the toner images T1 and T2 formed on the intermediate transfer belts 25*a* and 25 are simultaneously transferred to the paper P. Then, the toner images T1 and T2 are simultaneously fixed on the paper by the fixing unit 50.

As has been described, the toner images T1 and T2 of YMCK colors are developed by the developing unit groups 35*a* and 35*b* during one rotation of the photosensitive drums 21*a* and 21*b*. The toner images T1 and T2 of YMCK colors are transferred to the respective intermediate transfer belts 25*a* and 25*b*. The paper P is conveyed between the intermediate transfer belts 25*a* and 25*b*. The toner images T1 and T2 provided on the intermediate transfer belts 25*a* and 25*b* are simultaneously transferred to the respective sides of the paper P by means of the electric field developed between the secondary transfer rollers 40*a* and 40*b*. The paper P is horizontally transferred to the fixing unit 50 as it is, whereby the images are concurrently fixed on the respective sides of the paper. Color images can be formed on both sides of the paper without distortion at the same speed as that at which an image is formed on one side of the paper.

Although the multiple toner images T1 and T2 of YMCK colors have been developed during one rotation of the photosensitive drums 21*a* and 21*b* in the sixth embodiment, it is also possible to develop the toner images every color during one rotation of the photosensitive drums 21*a* and 21*b* and to transfer the thus-developed images to the intermediate transfer belts 25*a* and 25*b*. In this case, however, it is necessary to provide the double-sided image forming apparatus with the mechanism for bringing the secondary transfer rollers 40*a* and 40*b* in or out of contact with each other, as it is required in the fourth embodiment.

It is also possible to develop the toner images of one color every rotation of the photosensitive drums 21*a* and 21*b* and to transfer the thus-developed images to the intermediate transfer belts 25*a* and 25*b* by one operation. In this case, it is necessary to provide the double-sided image forming apparatus with the mechanism for bringing the photosensitive drums 21*a* and 21*b* in or out of contact with the intermediate transfer belts 25*a* and 25*b*.

(SEVENTH EMBODIMENT)

Figure 11:
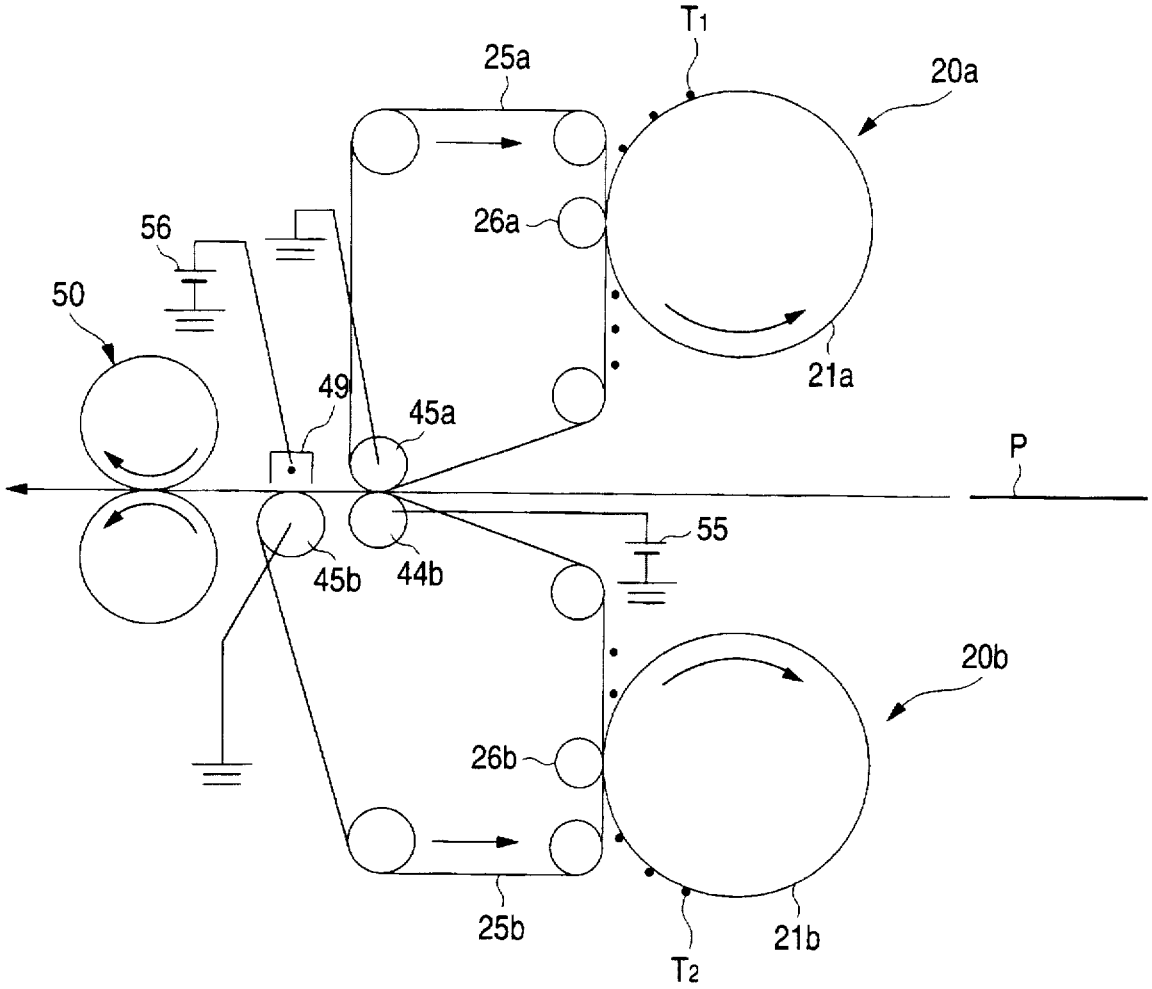
FIG. 11 is a schematic representation illustrating a double-sided image forming apparatus of a seventh embodiment.

FIG. 11 illustrates the outline of configuration of a seventh embodiment of a double-sided image forming apparatus to which the present invention is applied. The double-sided image forming apparatus of the seventh embodiment is substantially the same in essential configuration as the double-sided image forming apparatus of the first embodiment. The seventh embodiment is different from the first embodiment in the following points:

A first secondary transfer section consisting of a secondary transfer roller 44*b* and a back-up roller 45*a* is provided in the secondary transfer section where the first and second intermediate transfer belts 25*a* and 25*b* come into contact with or in proximity to each other. Further, a second secondary transfer section consisting of a secondary transfer corotron 49 and a backup roller 45*b*, is provided subsequent to the first secondary transfer section. Predetermined bias voltages 55 and 56 are applied to the secondary transfer roller 44*b* and the secondary transfer corotron 49.

In the seventh embodiment, negatively-charged toner is used for the toner images T1 and T2. DC +10 μA is applied to the primary transfer rollers 26*a* and 26*b*, and DC +2 kV is applied to the secondary transfer roller 44*b*. AC 8 kVp-p/600 Hz having DC +300 μA superimposed thereon is applied to the secondary transfer corotron 49. The back-up rollers 45*a* and 45*b* are grounded.

The imaging process of the double-sided image forming apparatus of the seventh embodiment will be described.

As in the first embodiment, the first and second toner images T1 and T2 are transferred to the first and second intermediate transfer belts 25*a* and 25*b* from the photosensitive drums 21*a* and 21*b*.

The paper P is conveyed to the secondary transfer section. First, the first toner image T1 is transferred to the paper P through the first secondary transfer section; namely, between the secondary transfer roller 44*b* and the back-up roller 45*a*. Subsequently, the second toner image T2 is consecutively transferred to the paper P through the second secondary transfer section; namely, between the secondary transfer corotron 49 and the back-up roller 45*b*. The paper having images transferred to both sides thereof are simultaneously fixed on the paper by the fixing unit 50.

In the secondary transfer section, the first toner image T1 is transferred to one side of the paper P by means of the electric field developed between the secondary transfer roller 44*b* and the back-up roller 45*a*. The second toner image T2 is transferred to the other side of the paper P by means of the electric field developed between the secondary transfer corotron 49 and the back-up roller 45*b*. The paper P is attracted by the second intermediate transfer belt 25*b* at the time of first secondary transfer of the image, which in turn makes it possible to accurately transfer images to the paper P without distorting the images.

As has been described above, the toner images T1 and T2 are transferred to the intermediate transfer belts 25*a* and 25*b* from the photosensitive drums 21*a* and 21*b*, respectively. The paper P is conveyed between the intermediate transfer belts 25*a* and 25*b*. The images are continuously transferred to the respective sides of the paper P from the intermediate transfer belts 25*a* and 25*b* by means of the electric fields developed between the secondary transfer roller 44*a* or the secondary transfer corotron 49 and the back-up rollers 45*a* and 45*b*. The paper P is transferred to the fixing unit 50 as it is, and the images provided on both sides of the paper are simultaneously fixed. As a result, distortion-free images can be formed on both sides of the paper without changing the polarity of the toner images at the same speed as that at which an image is formed on one side of the paper.

(EIGHTH EMBODIMENT)

Figure 12:
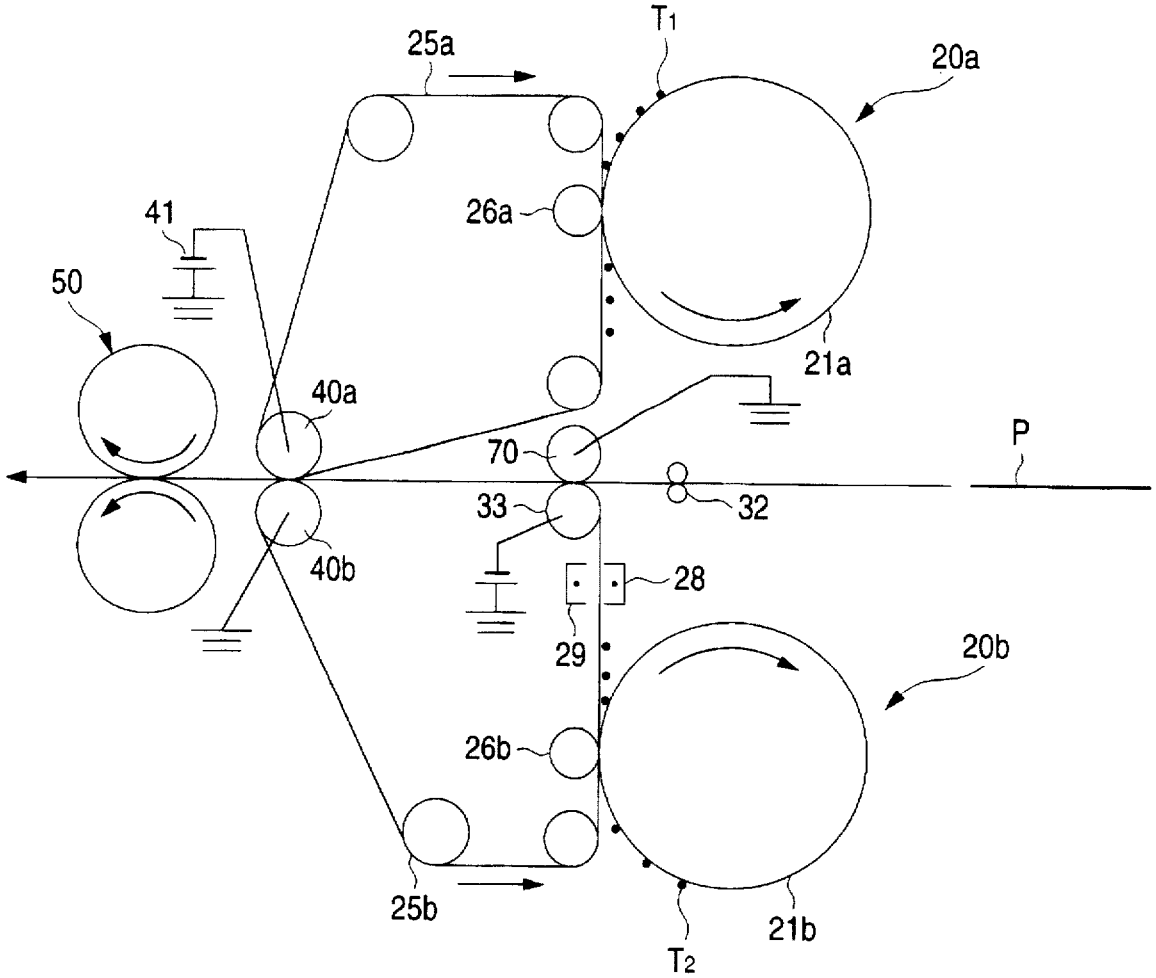
FIG. 12 is a schematic representation illustrating a double-sided image forming apparatus of an eighth embodiment.

FIG. 12 illustrates the outline of configuration of the double-sided image forming apparatus of the eighth embodiment to which the present invention is applied.

In the drawing, the double-sided image forming apparatus of the eighth embodiment is substantially the same in essential configuration as the double-sided image forming apparatus of the first embodiment. The eighth embodiment is different from the first embodiment in the following points:

A sucking roller 70 for causing the paper P to be attracted to the second intermediate transfer belt 25*b*, is provided opposite the tension roller 33 which is one of the rollers retaining the intermediate transfer belt 25*b*, in front of the area where the intermediate transfer belts 25*a* and 25*b* come into contact with or in proximity to each other.

In the eighth embodiment, negatively-charged toner is used for the toner images T1 and T2. DC +10 μA is applied to the primary transfer rollers 26*a* and 26*b*. AC 8 kVp-p/600 Hz having DC +1 kV superimposed thereon is applied to the polarity-reversing corotron 28, and AC 8 kVp-p/600 Hz having DC −1 kV superimposed thereon is applied to the polarity-reversing corotron 29. DC −20 μA is applied to the tension roller 33, and DC −2 kV is applied to the secondary transfer roller 30*a*. The secondary transfer roller 40*b* and the sucking roller 70 are grounded. Although an electric current having a negative polarity is applied to the tension roller 33 in the eighth embodiment, it is also possible to apply an electric current having a positive polarity to the same.

The imaging process of the double-sided image forming apparatus of the eighth embodiment will be described.

As in the first embodiment, the first and second toner images T1 and T2 are transferred from the first and second photosensitive drums 21*a* and 21*b* to the first and second intermediate transfer belts 25*a* and 25*b*. After the polarity of the second toner image T2 has been reversed by the pair of polarity-reversing corotrons 28 and 29, a voltage is applied to the tension roller 33 opposite the sucking roller 70. As a result, the paper P is placed on the surface of the second intermediate transfer belt 25*b* in a sucked manner with the second toner image T2 sandwiched between them. After images have been simultaneously transferred to the respective sides of the paper P by the secondary transfer section as in the first embodiment, the images are concurrently fixed on the paper by the fixing unit 50.

As has been described above, the toner images T1 and T2 are transferred to the intermediate transfer belts 25*a* and 25*b* from the photosensitive drums 21*a* and 21*b*, respectively. The paper P is conveyed to the second transfer section while the paper is placed on the intermediate transfer belt 25*b* in a sucked manner. The images are simultaneously transferred to the respective sides of the paper P from the intermediate transfer belts 25*a* and 25*b* by means of the electric field developed between the secondary transfer rollers 40*a* and 40*b*. The paper P is transferred to the fixing unit 50 as it is, and the images provided on both sides of the paper are simultaneously fixed. As a result, the images can be formed on both sides of the paper without distortion at the same speed as that at which an image is formed on one side of the paper.

Particularly, in the eighth embodiment, it is possible to make the attitude of the paper P stable when it enters the second transfer section by conveying the paper while it is placed on the second intermediate transfer belt 25*b* in a sucked manner with the second toner image T2 sandwiched between them.

(NINTH EMBODIMENT)

Figure 13:
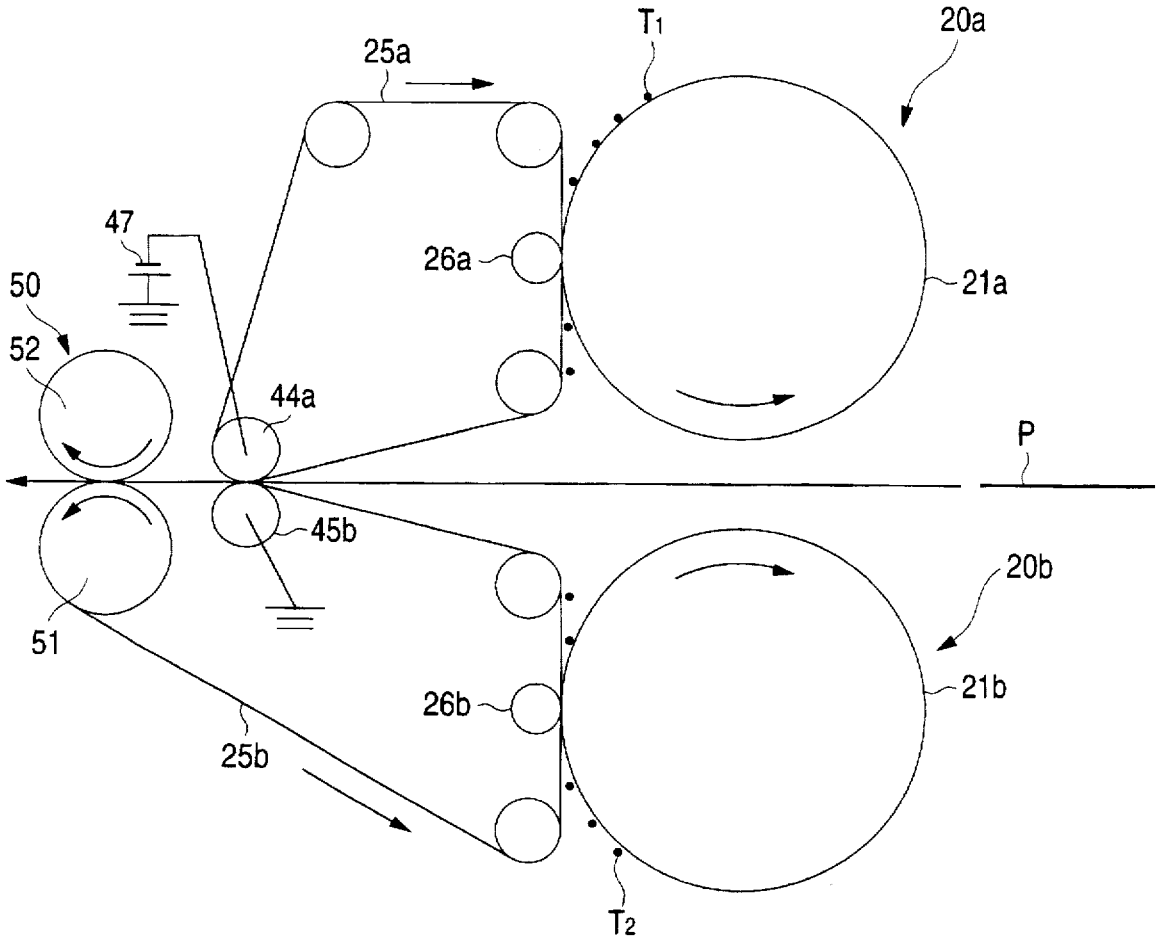
FIG. 13 is a schematic representation illustrating a double-sided image forming apparatus of an ninth embodiment.

FIG. 13 illustrates the outline of configuration of a ninth embodiment of a double-sided image forming apparatus to which the present invention is applied.

In the drawing, the double-sided image forming apparatus of the ninth embodiment is substantially the same in essential configuration as the double-sided image forming apparatus of the first embodiment. The ninth embodiment is different from the first embodiment in the following points:

A secondary transfer roller 44*a* which receives a predetermined bias voltage 47 and a back-up roller 45*b* are provided in the area where the intermediate transfer belts 25*a* and 25*b* come into contact with or proximity to each other. One of the rollers retaining the second intermediate transfer belt 25*b* is used as a fixing roller 51 which serves as one element of the fixing unit 50.

In the ninth embodiment, negatively-charged toner is used for the toner images T1 and T2. DC +10 μA is applied to the primary transfer rollers 26*a* and 26*b*, and DC −2 kV is applied to the secondary transfer roller 44*a*. The back-up roller 45*b* is grounded.

The imaging process of the double-sided image forming apparatus of the ninth embodiment will be described.

As in the first embodiment, the first and second toner images T1 and T2 are transferred to the first and second intermediate transfer belts 25*a* and 25*b* from the photosensitive drums 21*a* and 21*b*.

The first toner image T1 is transferred from the first intermediate transfer belt 25*a* to the paper P by means of the electric field developed between the secondary transfer roller 44*a* and the back-up roller 45*b*. The thus-transferred image is fixed on the paper by the fixing rollers 51 and 52 of the fixing unit 50. Further, the second toner image T2 is transferred to and fixed on the paper P at one time by means of the fixing rollers 51 and 52.

In the ninth embodiment, after the first toner image T1 has been normally transferred to the paper P from the fist intermediate transfer belt 25*a*, it is fixed. In contrast, the second toner image T2 is transferred from the second intermediate transfer belt 25*a* to and is fixed on the paper P at one time. As a result, it becomes possible to transfer and fix the first and second toner images to the respective sides of the paper without changing the polarity of the images T1 and T2.

As has been described above, after the toner image T1 has been transferred to the paper P from the intermediate transfer belt 25*a*, it is fixed. In contrast, the toner image T2 is transferred from the intermediate transfer belt 25*b* to and is fixed on the paper at one time. As a result, distortion-free images can be formed on both sides of the paper without changing the polarity of the toner images at the same speed as that at which an image is formed on one side of the paper.

(TENTH EMBODIMENT)

Figure 14:
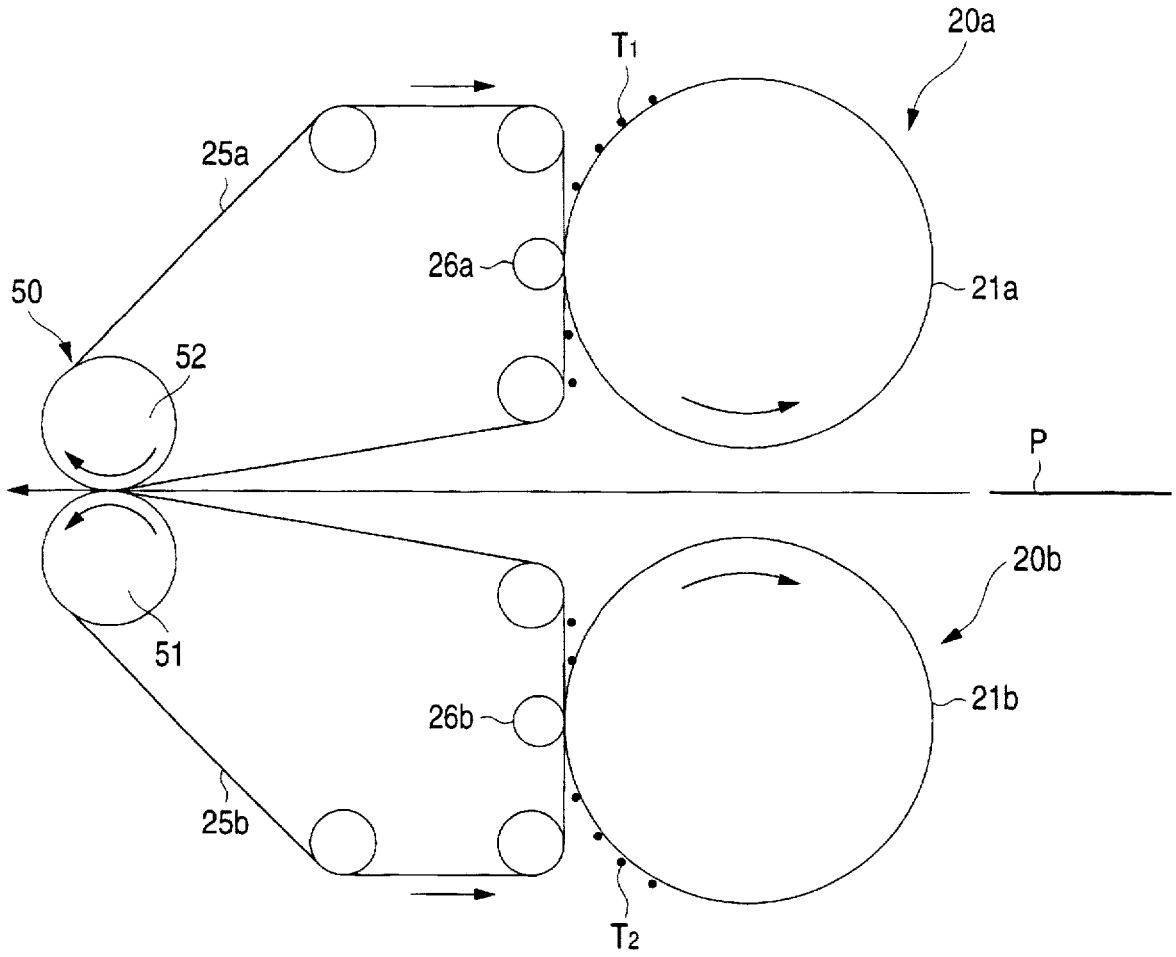
FIG. 14 is a schematic representation illustrating a double-sided image, forming apparatus of a tenth embodiment.

FIG. 14 illustrates the outline of configuration of a tenth embodiment of a double-sided image forming apparatus to which the present invention is applied.

In the drawing, the double-sided image forming apparatus of the tenth embodiment is substantially the same in essential configuration as the double-sided image forming apparatus of the ninth embodiment. The tenth embodiment is different from the ninth embodiment in the following points:

One of the rollers retaining the intermediate transfer belt 25*b* is used also as the fixing roller 51 of the fixing unit 50 in the area where the intermediate transfer belts 25*a* and 25*b* are brought into contact with or in proximity to each other.

According to the tenth embodiment, images are transferred and fixed to both sides of the paper P at one time. As a result, distortion-free images can be formed on both sides of the paper without changing the polarity of the toner images T1 and T2 at the same speed as that at which an image is formed on one side of the paper.

(ELEVENTH EMBODIMENT)

Figure 15:
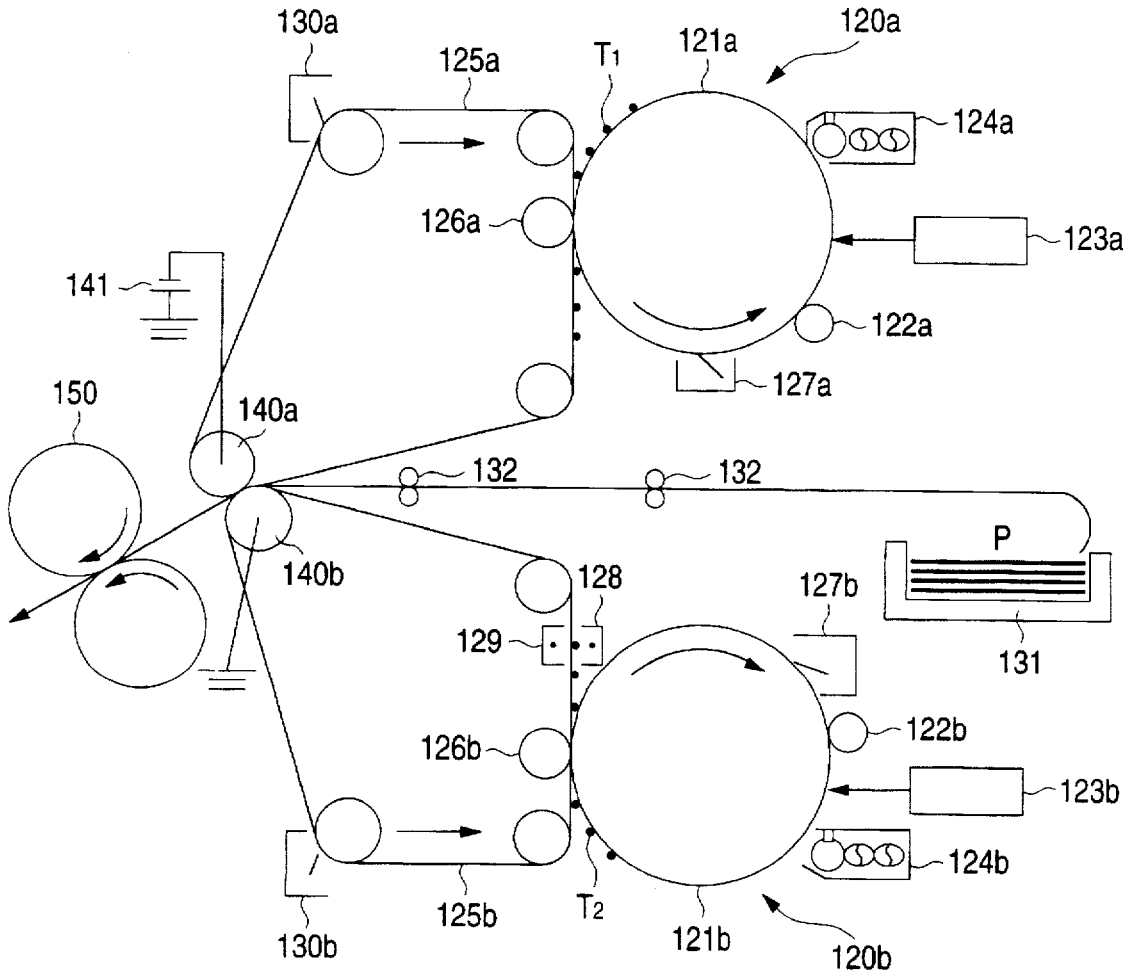
FIG. 15 is a schematic representation illustrating a double-sided image forming apparatus according to an eleventh embodiment of the present invention.

FIG. 15 illustrates the outline of configuration of an eleventh embodiment of a double-sided image forming apparatus to which the present invention is applied.

In the drawing, the double-sided image forming apparatus is comprised of a first image forming section 120*a* for forming a first image on a first plane of paper P; a second image forming section 120*b* for forming a second image on a second plane of the paper P; and a fixing unit 150 for fixing the images formed on the paper P after it has passed through the first and second image forming sections 120*a* and 120*b*.

In the eleventh embodiment, the image forming sections 120*a* and 120*b* are respectively comprised of: photosensitive drums 121*a* and 121*b*, charging rollers 122*a* and 122*b* for electrifying the surface of the photosensitive drums 121*a* and 121*b*, exposure units 123*a* and 123*b* for writing electrostatic latent images for use as the first and second images into the charged photosensitive drums 121*a* and 121*b*, developing units 124*a* and 124*b* for making the latent images written into the photosensitive drums 121*a* and 121*b* visible using toner, intermediate transfer belts 125*a* and 125*b* provided so as to be in contact with the photosensitive drums 121*a* and 121*b*, primary transfer rollers 126*a* and 126*b* for primarily transferring the toner images T1 and T2 (for example, positive images in the eleventh embodiment) from the photosensitive drums 121*a* and 121*b* to the intermediate transfer belts 125*a* and 125*b*, and cleaners 127*a* and 127*b* for eliminating residual toner from the photosensitive drums 121*a* and 121*b*.

A pair of polarity-reversing corotrons 128 and 129 are disposed so as to be opposite to each other with the intermediate transfer belt 125*b* sandwiched between them in a downstream direction with reference to the primary transfer position of the intermediate transfer belt 125*b* of the second image forming section 120*b*.

In the eleventh embodiment, the intermediate transfer belts 125*a* and 125*b* are wrapped around a required number of retaining rollers (one of them is a drive roller, and the other rollers are driven rollers) and are arranged so as to rotate in synchronization with the photosensitive drums 121*a* and 121*b*. Reference numerals 130*a* and 130*b* are belt cleaners for eliminating residual toner from the intermediate-transfer belts 125*a* and 125*b*.

The intermediate transfer belts 125*a* and 125*b* are made of resin such as polyimide, acrylic resin, polyvinylchloride, polyester, polycarbonate, or polyethylene terephthalate (PET), or various types of rubber together with a required content of an anti-static agent such as carbon black. The intermediate transfer belts are formed so as to have a volume resistivity of $10^9$ to $10^{14}$ Ω·cm. The thickness of the belt is set to; e.g., 0.08 mm.

The retaining rollers disposed in the area where the intermediate transfer belts 125*a* and 125*b* come into contact with or in proximity to each other, are made up of secondary transfer rollers 140*a* and 140*b*.

The secondary transfer rollers 140*a* and 140*b* may perform transferring operations even if they are conductive. However, if images are transferred to small-sized paper, an excessively large current flow between the secondary transfer rollers 140*a* and 140*b* as a result of direct contact between the first and second intermediate transfer belts 125*a* and 125*b*. As a result, a sufficient transfer electric field cannot be formed, which in turn results in transfer errors. Since the intermediate transfer belts 125*a* and 125*b* are apt to become damaged, it desirable to use a conductive roller coated with a semi-conductive or insulating material for at least the roller that receives an applied bias voltage.

In the eleventh embodiment, as the secondary transfer rollers 140*a* and 140*b*, there are used a roller made of a metal shaft coated with EPDM rubber which includes dispersed carbon black and is formed so as to have a volume resistivity of $10^5$ Ω·cm. Transfer bias 141 is applied to the shaft of the secondary transfer roller 140*a*, whereas the shaft of the secondary transfer roller 140*b* is grounded.

As another coating material, there may be used polyurethane or silicon rubber which includes dispersed conductive particles (carbon black or aluminum etc.,) or ion conductive material ($LiClO_4$ etc.). It is desirable to set the volume resistivity of such a coating material to $10^5$ to $10^9$ Ω·cm.

Figure 16:
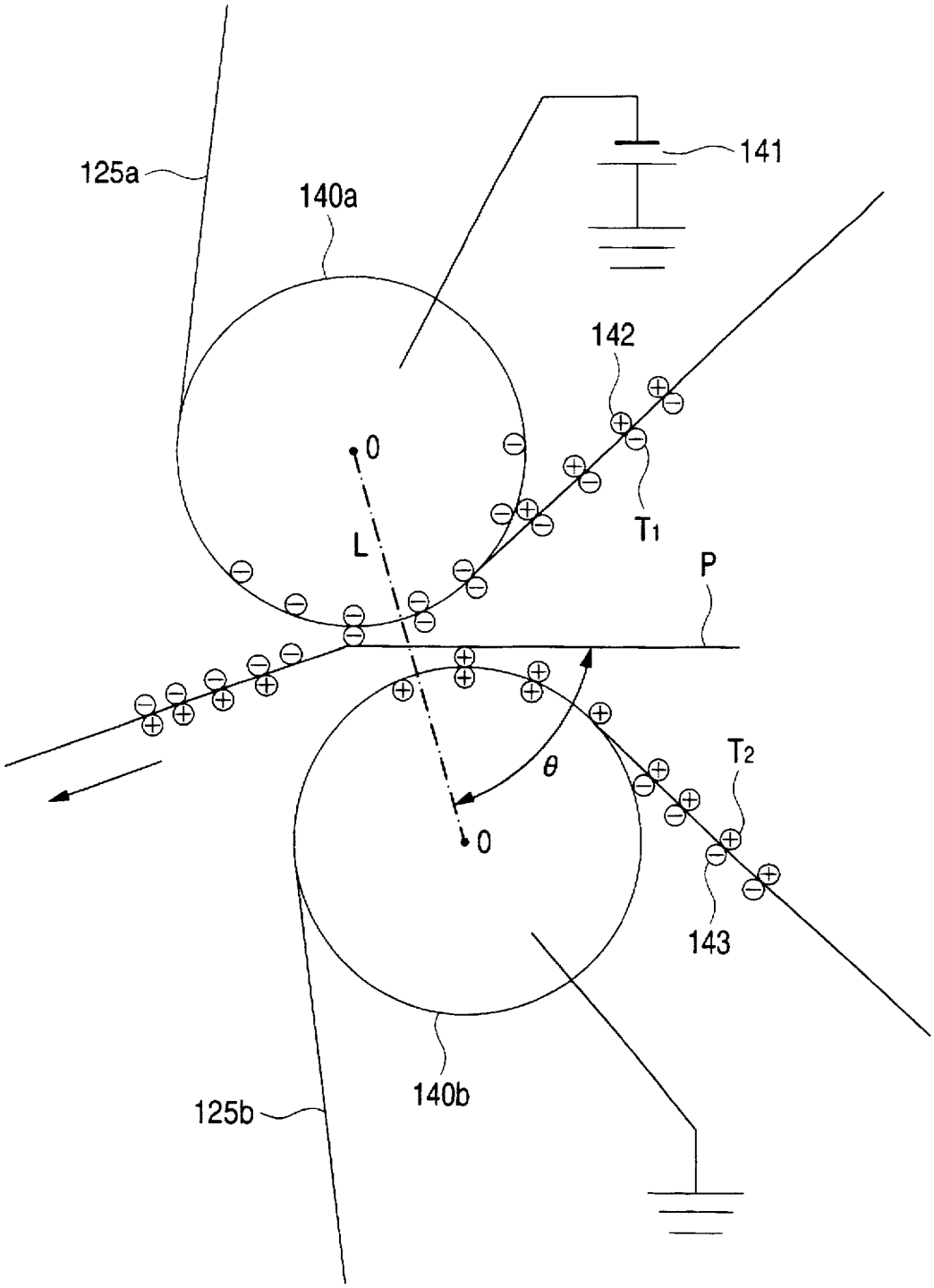
FIG. 16 is a schematic representation illustrating the details of a secondary transfer device used in the eleventh embodiment.

In the eleventh embodiment, as illustrated in FIG. 16, the secondary transfer rollers 140*a* and 140*b* are arranged such that a line L connecting the center axes O of the secondary transfer rollers 140*a* and 140*b* forms an angle with respect to the direction in which the paper P enters the fixing unit (for example, in the eleventh embodiment, the line L connecting between the center axes O forms θ=80° to 50° in a counterclockwise direction with respect to the direction in which the paper P enters the fixing unit). The inclination angle θ may be changed according to the thickness of the paper P.

Further, in the eleventh embodiment, negatively charged toner is used for toner T1 and T2. DC +10 μA is applied to the primary transfer rollers 126*a* and 126*b*. AC 8 kVp-p/600 Hz having DC +1 kV superimposed thereon is applied to the polarity-reversing corotron 128, and AC 8 kVp-p/600 Hz having DC −1 kV superimposed thereon is applied to the polarity-reversing corotron 129. Further, DC −2 kV is applied to the secondary transfer roller 140*a*.

The outer diameter of the first and second photosensitive drums 121*a* and 121*b* and the circumferential length of the first and second intermediate transfer belts 125*a* and 125*b* are set to an identical length.

Further, the distance between the secondary transfer position and the fixing unit 150 is set so as to become smaller than the length of the paper having the minimum size. The speed of rotation of the fixing rollers is set so as to become equal to or slightly slower than the speed of the intermediate transfer belts 125*a* and 125*b*.

Moreover, the upper and lower fixing rollers of the fixing unit 150 are formed into an identical shape so that a fixing nip becomes linear, and heaters are housed in the respective fixing rollers. In FIG. 16, reference numeral 131 designates a paper tray; and 132 designates a conveyor roller for conveying the paper P.

Next, the imaging process of the double-sided image forming apparatus according to the eleventh embodiment will be described.

The first toner image T1 formed on the first photosensitive drum 121*a* is transferred to the first intermediate transfer belt 125*a* which travels substantially at the same speed as that at which the first photosensitive drum 121*a* travels, by means of the primary transfer roller 126*a*.

Similarly, at the same timing at which the image is transferred from the first photosensitive drum 121*a*, the second toner image T2 formed on the second photosensitive drum 121*b* is transferred to the second intermediate transfer belt 125*b* by means of the primary transfer roller 126*b*. The polarity of the second toner image T2 is reversed by application of a voltage to the polarity-reversing corotrons 128 and 129 which are provided so as to be opposite to each other with the second intermediate transfer belt 125*b* sandwiched between them.

The paper P is conveyed at appropriate timing from the paper tray 131 so as to travel between the secondary transfer rollers 140*a* and 140*b* which are shifted from each other in the direction in which the paper enters the fixing unit. After the toner images T1 and T2 have been simultaneously transferred from the intermediate transfer belts 125*a* and 125*b* to the paper P while bending stress acts on the paper P, they are fixed on the paper by the fixing unit 150 at the same time.

The principle of secondary transfer of an image will be described in detail upon reference chiefly to FIG. 16.

The bias voltage 141 having a negative polarity is applied to the secondary transfer roller 140*a*, so that positive charges 142 on the reverse side of the intermediate transfer belt 125*a* are canceled. As a result of homopolar repulsive force, the toner image T1 having a negative polarity is transferred from the intermediate transfer belt to the paper P.

In contrast, the secondary transfer roller 140*b* is grounded, so that negative charges 143 on the reverse side of the intermediate transfer belt 125*b* are canceled. The toner image T2 formed on the second intermediate transfer belt 125*b* whose polarity has been reversed to a positive polarity by the polarity-reversing corotrons 128 and 129, is transferred to the paper P by attraction of the secondary transfer roller 140*a*. In this way, images can be simultaneously transferred to both sides of the paper P.

Since the secondary transfer rollers 140*a* and 140*b* are arranged such that the line L connecting the center axes O forms θ (θ≠90°) with respect to the direction in which the paper P enters the gap between the secondary transfer rollers 140*a* and 140*b*), the leading edge Pa of the paper P that has passed between the secondary transfer rollers 140*a* and 140*b* is deformed (or the direction of the leading edge Pa is changed) in the direction substantially at right angles with respect to the line L (at a nipping position of the fixing unit 150 of the eleventh embodiment). During the course of travel to the fixing unit 150, the attitude of the paper P becomes stable because of the flexural rigidity of the paper P.

In a case where an image is formed on one side of the paper, it is possible to prevent the reverse side of the paper from being stained by application of a bias voltage having the polarity opposite to that of the ordinary transfer bias voltage, to the primary transfer roller 126*a* or 126*b*. In addition, it is also possible to switch a bias voltage for developing purposes or to separate the photosensitive drums 121*a* and 121*b* from the intermediate transfer belts 125*a* and 125*b*.

As has been described above, the toner images T1 and T2 are transferred from the photosensitive drums 121*a* and 121*b* to the intermediate transfer belts 125*a* and 125*b*. Then, the paper P travels between the secondary transfer rollers 140*a* and 140*b* shifted from each other in the direction in which the paper P enters the fixing unit. The images formed on the intermediate transfer belts 125*a* and 125*b* are simultaneously transferred to the respective sides of the paper P while a bending stress is exerted on the paper P, and the paper is conveyed to the fixing unit 150 as it is. As a result, the images are simultaneously fixed on the respective sides of the paper P. Consequently, images can be formed on both sides of a sheet of paper without distortion at the same speed as that at which an image is formed on one side of the paper.

(TWELFTH EMBODIMENT)

Figure 17:
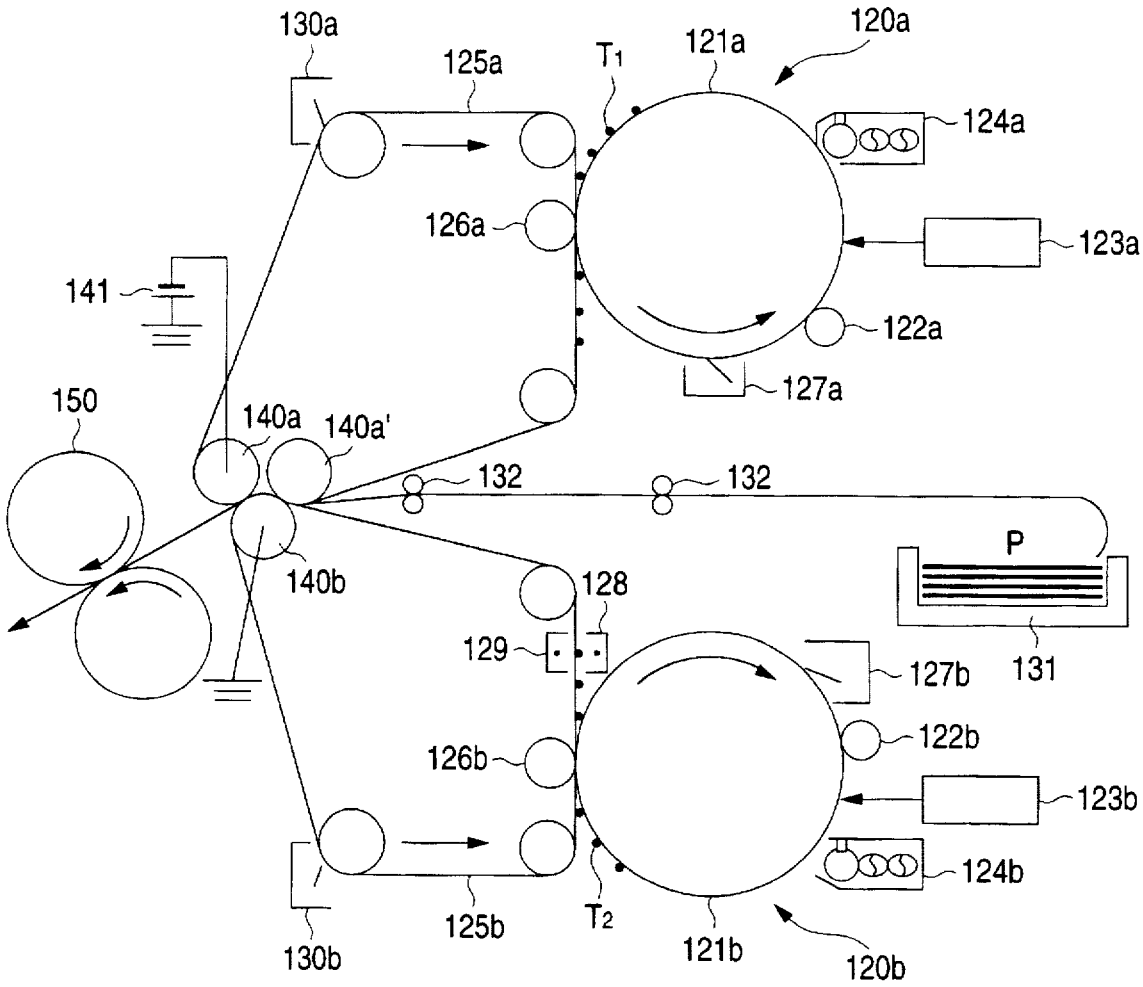
FIG. 17 is a schematic representation illustrating a double-sided image forming apparatus of a twelfth embodiment.

FIG. 17 illustrates the outline of configuration of a twelfth embodiment of a double-sided image forming apparatus to which the present invention is applied.

In the drawing, the double-sided image forming apparatus of the twelfth embodiment is substantially the same in essential configuration as the double-sided image forming apparatus of the eleventh embodiment. The twelfth embodiment is different from the eleventh embodiment in the configuration of the secondary transfer device. The same constituent elements as those used in the first embodiment will be assigned the same reference numerals, and their detailed explanations will be omitted here.

More specifically, in the twelfth embodiment, the secondary transfer device has the same secondary transfer rollers 140*a* and 140*b* as those used in the eleventh embodiment [the line L connecting between the center axes O of the secondary transfer rollers 140*a* and 140*b* forms θ (θ≠90°) in a counterclockwise direction with respect to the direction in which the paper P enters the fixing unit.] An auxiliary transfer roller 140*a'* is disposed opposite the secondary transfer roller 140*b* in front of the secondary transfer roller 140*a* of the first intermediate transfer belt 125*a* (the line connecting the center axes of the secondary transfer rollers forms an angle in a clockwise direction).

According to the twelfth embodiment, the leading edge of the paper P is deformed so as to curl up during the course of its travel between the auxiliary transfer roller 140*a'* and the secondary transfer roller 140*b*. The thus-deformed leading edge is again deformed so as to curl down during the course of its travel between the secondary transfer rollers 140*a* and 140*b*. As a result, the bending stress exerted on the paper P can be increased further. As a result of travel of the leading edge of the paper P between the secondary transfer rollers 140*a* and 140*b*, the flexural rigidity of the leading edge is increased accordingly. The attitude of the paper P at the time of entry to the fixing unit 150 becomes stable further.

Although the auxiliary transfer roller 140*a'* is used only to deform the paper P in the present embodiment, it goes without saying that the auxiliary transfer roller 140*a'* can be arranged so as to perform substantial transfer operations upon receipt of the transfer bias voltage 141 which is the same as it is applied to the secondary transfer roller 140*a*.

(THIRTEENTH EMBODIMENT)

Figure 18:
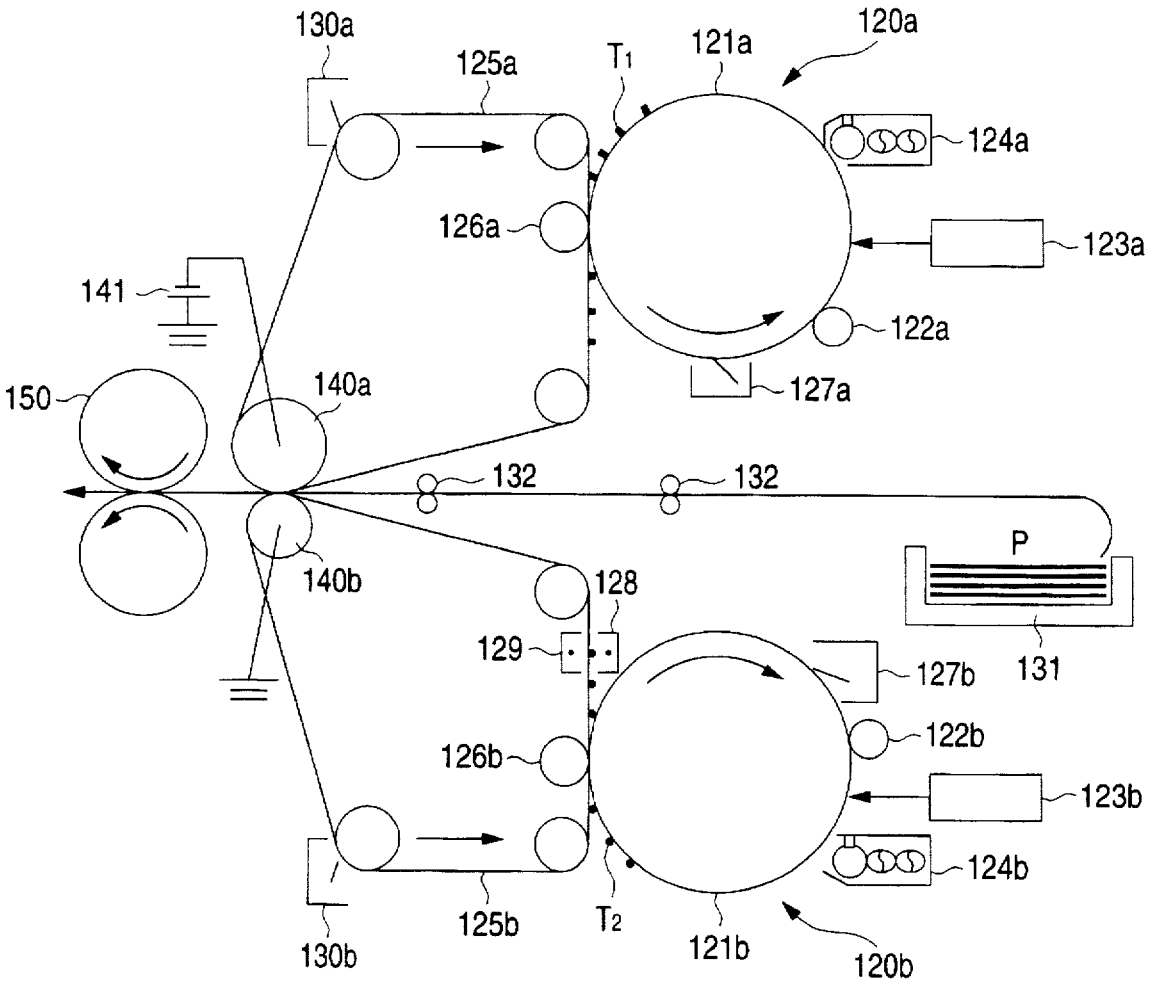
FIG. 18 is a schematic representation illustrating a double-sided image forming apparatus of a thirteenth embodiment.

FIG. 18 illustrates the outline of configuration of a thirteenth embodiment of a double-sided image forming apparatus to which the present invention is applied.

In the drawing, the double-sided image forming apparatus of the thirteenth embodiment is substantially the same in essential configuration as the double-sided image forming apparatus of the eleventh embodiment. The thirteenth embodiment is different from the eleventh embodiment in the configuration of the secondary transfer device.

More specifically, in the thirteenth embodiment, the secondary transfer device is arranged such that the area of the secondary transfer roller 140*a* of the first intermediate transfer belt which is in contact with the secondary transfer roller 140*b*, becomes deformed by a pressure received from the secondary transfer roller 140*b* of the second intermediate transfer belt 125*b* by reducing the hardness of the secondary transfer roller 140*a* of the first intermediate transfer belt 125*a*, thereby exerting bending stress on the paper P.

According to the thirteenth embodiment, it is possible to control the force bending the paper P by changing the hardness of the secondary transfer roller 140*a* or 140*b*. Further, the secondary transfer roller 140*a* becomes deformed as required by virtue of the flexural rigidity of the paper P. Therefore, it is possible to set the bending force such that the degree of deformation becomes smaller for thick paper but becomes greater for thin paper.

(FOURTEENTH EMBODIMENT)

Figure 19:
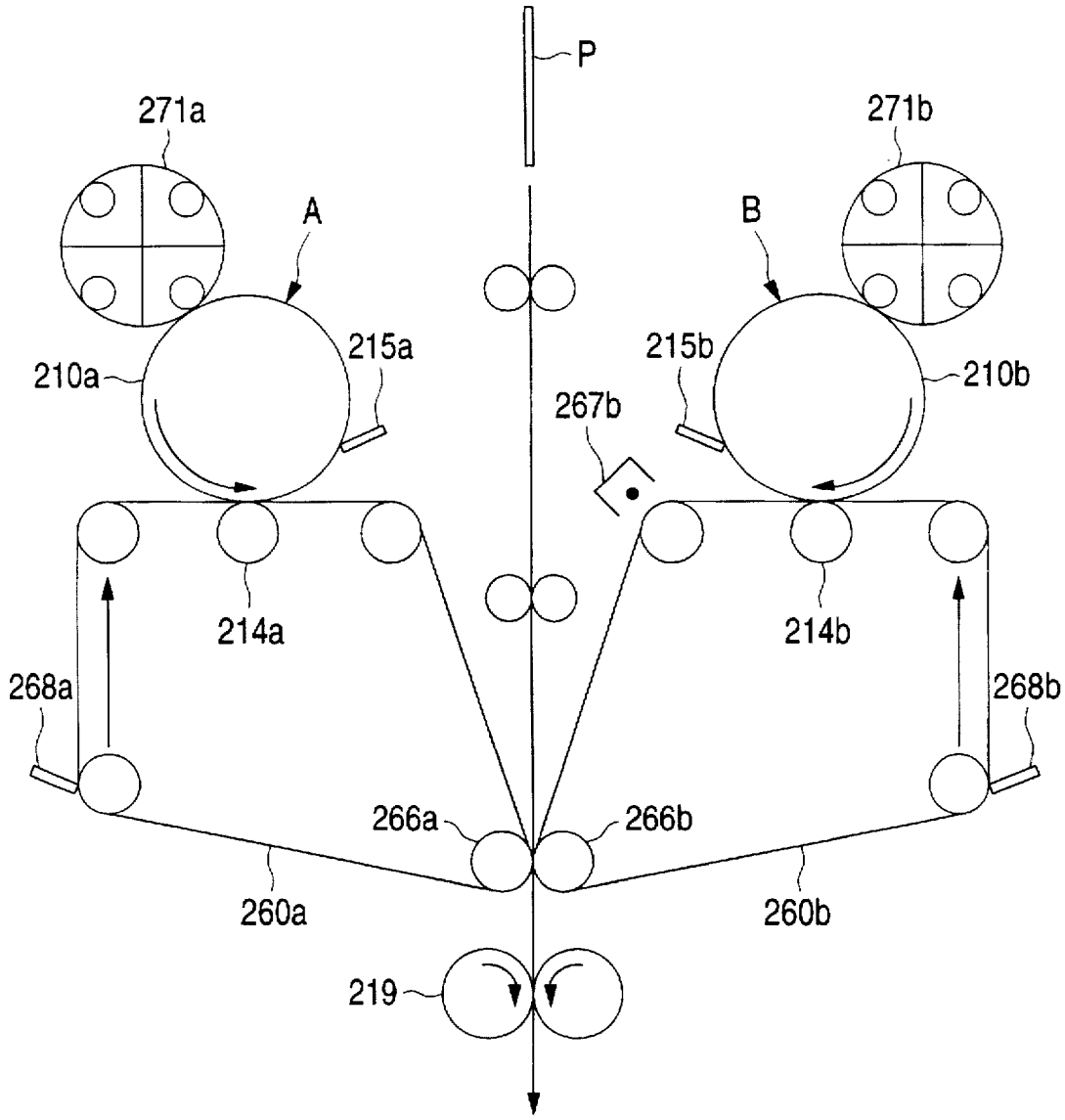
FIG. 19 is a schematic representation illustrating a pressing/detaching mechanism for use with an intermediate transfer belt module used in a fourteenth embodiment of the present invention.

FIG. 19 illustrates a fourteenth embodiment of the double-sided image forming apparatus to which the present invention is applied.

In the drawing, the double-sided image forming apparatus is provided with image forming sections A and B for forming images on the respective sides of paper P, and intermediate transfer belts 260*a* and 260*b* provided in the respective image forming sections A and B.

In the fourteenth embodiment, the image forming sections A and B are provided with photosensitive drums 210*a* and 210*b*, and the intermediate transfer belts 260*a* and 260*b* disposed opposite the photosensitive drums 210*a* and 210*b*. Unillustrated charging elements, exposure units, rotary developing units 271*a* and 271*b* for full-color purposes [i.e., yellow (Y), magenta (M), cyan (C), and black (K) in the fourteenth embodiment], cleaning blades 215*a* and 215*b*, and others are provided, as various types of electrophotograpy devices, around the photosensitive drums 210*a* and 210*b*. Transfer rollers 214*a* and 214*b* for use in primary transfer operation are disposed behind the intermediate transfer belts 260*a* and 260*b* opposite the photosensitive drums 210*a* and 210*b*.

In the fourteenth embodiment, the intermediate transfer belts 260*a* and 260*b* are wrapped around a required number of support rollers and are brought into contact or in proximity to each other in the vicinity of a fixing unit 210. The support rollers positioned in the area where the intermediate transfer belts 260*a* and 260*b* come into contact with or in proximity to each other act also as secondary transfer rollers 266*a* and 266*b*.

In FIG. 19, reference numeral 267*b* designates a polarity-reversing device such as a corotron for reversing the polarity of the toner image formed in the image forming section B; and reference numerals 268*a* and 268*b* designate cleaning blades for eliminating residual toner from the surface of the intermediate transfer belts 260*a* and 260*b*. In a normal condition, the cleaning blades 268*a* and 268*b* are retracted away from the intermediate transfer belts 260*a* and 260*b*. At the point in time which a cycle of color image forming operations have been completed, the cleaning blades 268*a* and 268*b* are brought into contact with the intermediate transfer belts 260*a* and 260*b*. Further, the secondary transfer rollers 266*a* and 266*b* are also arranged so as to separate from each other during formation of color images.

In the fourteenth embodiment, the image forming cycle is carried out for each color component in either the image forming section A or B that forms images on the paper P. After the images have been primarily transferred to the intermediate transfer belt 260*a* or 260*b* from the photosensitive drum 210*a* or 210*b* in a sequential manner, the thus-transferred images are further transferred to any one of the sides of the paper P. Then, the paper is conveyed to the fixing unit 219.

At this time, in the photosensitive drum 210*a* or 210*b* facing the plane of the paper P on which no image is formed, a toner band is supplied to the cleaning blade 215*a* or 215*b*. As a result, the friction between the photosensitive drum 210*a* or 210*b* and the cleaning blade 215*a* or 215*b* is reduced, thereby preventing deterioration of picture quality resulting from abrasion of photosensitive drums 210*a* and 210*b*, cleaning failures resulting from abrasion of edges of the cleaning blades 215*a* and 215*b*, squeaking noises caused by the cleaning blades, and curling-up of the paper.

Further, in the fourteenth embodiment, the present invention is not limited to the previously-described embodiments. There may be provided a pressing/detaching mechanism for use with the cleaning blades 215*a* and 215*b* of the image forming sections A and B. As a result, in a single-sided image forming mode, the cleaning blade is detached from the photosensitive drum at appropriate timing in either the image forming section A or B corresponding to the plane of the paper P on which no image is formed.

Figure 20:
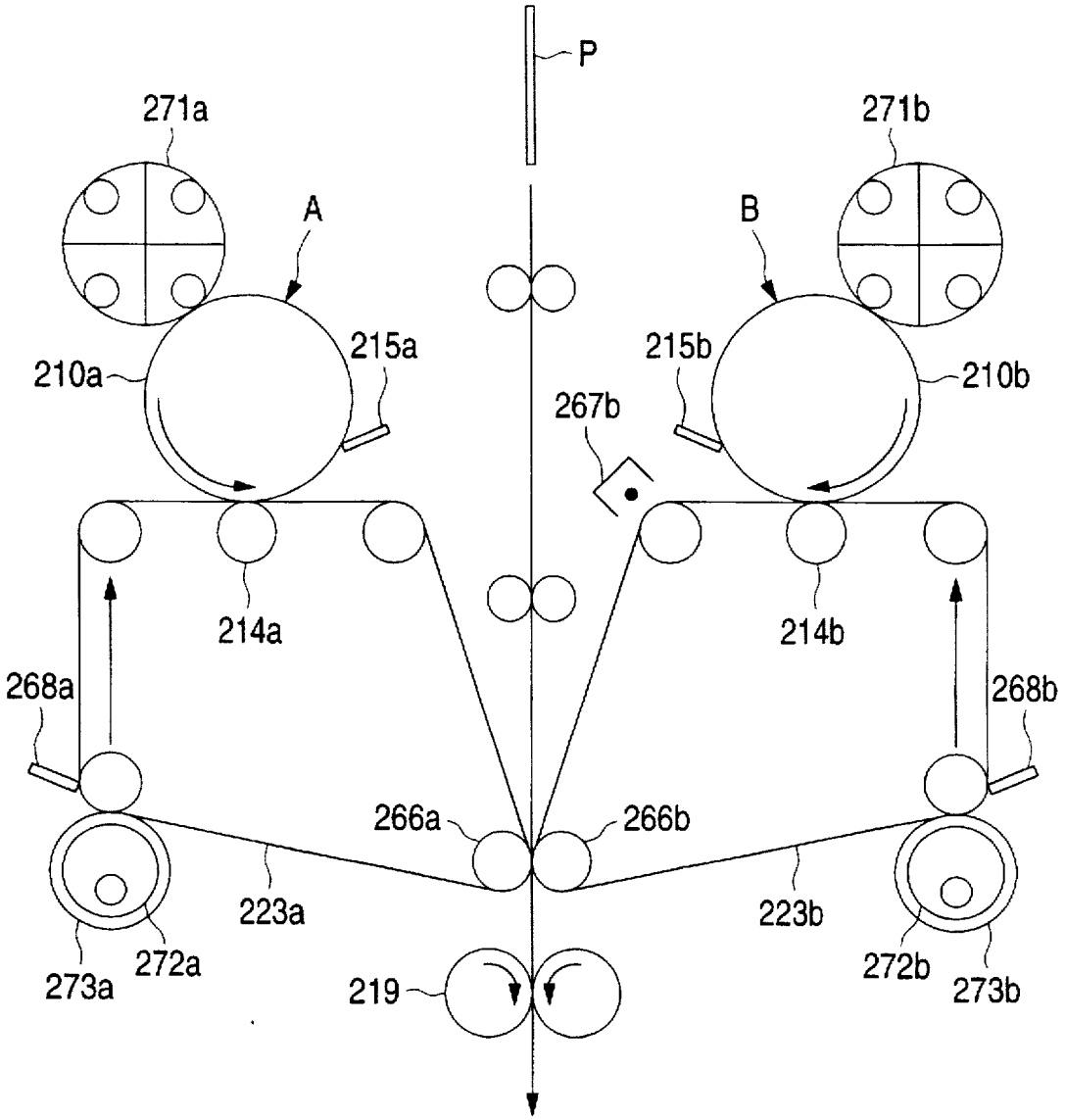
FIG. 20 is a schematic representation illustrating the outline of a double-sided image forming apparatus of the fourteenth embodiment.

Further, as illustrated in FIG. 20, the intermediate transfer belts 260*a* and 260*b* are assembled into a module. Driven rollers 273*a* and 273*b* which incorporate eccentric rollers 272*a* and 272*b* as the rotary shafts, are provided so as to come into contact with the lower peripheral surface of the intermediate transfer belt module (not shown). For example, the intermediate transfer belt module may be actuated so as to pivot on the transfer rollers 266*a* and 266*b* by rotating the eccentric rollers 272*a* and 272*b*.

In this case, it is only required to separate the photosensitive drum 210*a* or 210*b* corresponding to the plane of the paper P on which no image is recorded during a single-sided image forming mode, at appropriate timing, from the intermediate transfer belt 260*a* or 260*b*.

As has been described above, according to the present invention, a first image formed on a first image carrier is primarily transferred to a first intermediate transfer member. In contrast, a second image formed on a second image carrier is primarily transferred to a second intermediate transfer member. The images formed on the intermediate transfer members are secondarily transferred to the respective sides of recording material while the recording material is retained by both of the intermediate transfer members or by one of them. Hence, it becomes possible to form high-quality images on both sides of the paper at the same speed as that at which an image is formed on one side of the paper, without distortion of the images and misalignment between the images on both sides.

Particularly, so long as the images formed on the intermediate transfer members are secondarily transferred to the recording material in the area where the first and second intermediate transfer members come into contact with or in proximity to each other, it becomes possible to reliably retain the recording material with respect to both intermediate transfer members. Therefore, prevention of the distortion of the images formed on both sides of the recording material can be ensured.

Further, if the recording material is retained on the second intermediate transfer member in a sucked way in the area where the first and second intermediate transfer members come into contact with or in proximity to each other, and if the second image formed on the second intermediate transfer member is transferred to a second plane of the recording material after the first image formed on the first intermediate transfer member has been transferred to a first plane of the recording material, it is possible to freely set the layout of the first and second images in the secondary transfer section.

In the present invention, if images are simultaneously transferred to both sides of the recording material in the area where the intermediate transfer members come into contact with or in proximity to each other, a transfer device can be shared, which in turn makes it possible to simplify the image forming apparatus as compared with the image forming apparatus that sequentially transfers images to both sides of the recording material for each side of the paper. Further, it is possible to ensure prevention of distortion of the first image during the course of its travel to or from the second transfer section or in the secondary transfer section subsequent to the primary transfer section.

Particularly, in the double-sided image forming apparatus that forms the first and second images by electrophotography, so long as the first and second images formed on the intermediate transfer members are caused to become opposite in polarity to each other in the secondary transfer area, simultaneous transfer of the first and second images to the respective sides of the recording material can be ensured.

Further, according to the present invention, a pair of transfer members are disposed in the secondary transfer area so as to be opposite to each other with the intermediate transfer members sandwiched between them. If a transfer bias voltage is applied to one of the transfer members, and if the other transfer members is grounded, it becomes possible to simultaneously transfer images to the recording material by means of the homopolar repulsive force developed between the image and the transfer member on the back of the intermediate transfer member retaining the image and the attraction occurring between the image and the transfer member facing that image.

In the present invention, if a pair of transfer members are disposed in the secondary transfer area with the intermediate transfer members sandwiched between them, and if the transfer bias voltages which are opposite in polarity to each other are applied to the transfer members, simultaneous transfer of the images to both sides of the paper can be ensured by means of the attraction occurring between the image and the transfer member facing the image.

If the images formed on the intermediate transfer members are consecutively transferred to the respective sides of the recording material in the area where the intermediate transfer members come into contact with or in proximity to each other, it is possible to reliably prevent the first image from being distorted during the course of travel of the recording material between the first and second transfer sections or in the secondary transfer section, as compared with the image forming apparatus comprising the first and second transfer sections provided separately from each other. Further, the conditions for transferring the first and second images; e.g., application of a transfer bias voltage to the transfer member, become feasible, which in turn enables a transfer electric field to be controlled so as to be suitable with the respective images. Therefore, transfer of the images to both sides of the recording material can be ensured.

In the present invention, provided that the intermediate transfer members are arranged so as to carry color images; that the intermediate transfer members are separated from each other when the images formed on the intermediate transfer members pass through the secondary transfer area without being transferred to the recording material; and that the intermediate transfer members are brought into contact with or in proximity to each other when the images formed on both sides of the intermediate transfer members are transferred to the recording material, it is possible to form color images at high speed on both sides of the recording material by latching the intermediate transfer members and transferring the images to the recording material after image components of a plurality of colors have been transferred to the intermediate transfer members.

In the present invention, provided that the image carrier is made up of a group of color component image carriers, each of which carries a color image component, and that the intermediate transfer member is arranged to carry the image components received from the group of color component image carriers, it becomes possible to transfer the image components of a plurality of colors to the recording material from the intermediate transfer member after the image components have been transferred to the intermediate transfer member during one rotation of the intermediate transfer member. As a result, color images can be formed on both sides of the recording material at the same productivity as that at which monochrome images are formed on both sides of the recording material.

Of the transfer paths for the recording material, the path corresponding to the second transfer area is provided in substantially a vertical direction. If fixing means for fixing unfixed images formed on both sides of the recording material is provided below the secondary transfer area, it becomes possible to make the attitude of the recording material after the passage of the secondary transfer area. As a result, it is possible to make the attitude of the recording material stable when it enters the fixing means, which in turn enables prevention of distortion of an image or crumpling of the recording material.

In the present invention, provided that the recording material is previously attached to the first or second intermediate transfer member in a sucked manner in front of the second transfer area, thereby ensuring formation of images on both sides of the recording material without distortions.

Further, provided that images are transferred and fixed to the paper in the secondary transfer section at one time, images can be easily formed on both sides of the paper without the need of fixing means.

What is claimed is:

1. A double-sided image forming method comprising:

a first image primary transfer step for transferring a first image carried by a first image carrier to a first intermediate transfer member;

a second image primary transfer step for transferring a second image carried by a second image carrier to a second intermediate transfer member;

a first image secondary transfer step for retaining the recording material in a sucked way so as to correspond to the second image formed on the second intermediate transfer material and for secondarily transferring the first transfer image from the first intermediate transfer member to the side of the recording material facing the first intermediate transfer member, in the area where the first intermediate transfer material and the second intermediate transfer material come into contact with or in proximity to each other; and a second image secondary transfer step for secondarily transferring the primarily transferred image from the second intermediate transfer member to the side of the recording material facing the second intermediate transfer member while the recording material is sucked and retained by the second intermediate transfer member after the first image secondary transfer step.

2. A double-sided image forming apparatus comprising:

a first image carrier for carrying a first image;

a first intermediate transfer member disposed so as to be opposite to the first image carrier;

first intermediate primary transfer means for primarily transferring the first image from the first image carrier to the first intermediate transfer member;

a second image carrier for carrying a second image;

a second intermediate transfer member disposed so as to be opposite to the second image carrier;

second intermediate primary transfer means for primarily transferring the second image from the second image carrier to the second intermediate transfer member; and intermediate secondary transfer means for secondarily transferring the primarily transferred images from the respective intermediate transfer members to both sides of a recording material, in the area where the first intermediate transfer material and the second intermediate transfer material come into contact with or in proximity to each other, wherein said intermediate second, transfer means comprises a pair of transfer members for respectively transferring images to said first and second sides of said recording material, said transfer members being provided so as to be opposite to each other with said first and second intermediate transfer members sandwiched therebetween, wherein the primarily transferred images are secondarily transferred to the first and second sides of said recording material in a consecutive manner by means of said transfer members.

3. The double-sided image forming apparatus of claim 2, wherein said intermediate secondary transfer means simultaneously transfers images to both sides of said recording material.

4. The double-sided image forming apparatus of claim 3, wherein in a case where the first and second images are formed by electrophotography, the first and second images carried by said first and second intermediate transfer members are opposite to each other in polarity within the secondary transfer region.

5. The double-sided image forming apparatus of claim 3, wherein said intermediate secondary transfer means is comprised of a pair of transfer members which are disposed so as to be opposite to each other with said first and second intermediate transfer members sandwiched therebetween, and a transfer bias voltage is applied to one of said transfer members, and the other transfer member is grounded.

6. The double-sided image forming apparatus of claim 3, wherein said intermediate secondary transfer means includes;

a pair of transfer members which are disposed so as to be opposite to each other with said first and second intermediate transfer members sandwiched therebetween, and transfer bias voltages which are opposite in polarity to each other are applied to the respective transfer members.

7. The double-sided image forming apparatus of claim 2, wherein said intermediate secondary transfer means sequentially and continuously transfers images to the respective sides of said recording material for each single side of the recording material.

8. The double-sided image forming apparatus of claim 7, wherein in a case where the first and second images are formed by electrophotography, the first and second images carried by said first and second intermediate transfer members are opposite to each other in polarity within the secondary transfer region.

9. The double-sided image forming apparatus of claim 2, wherein said first and second intermediate transfer members carry color images which are formed by transferring in multiple image components having a plurality of colors, and when said recording material passes through a secondary transfer area without transferring the images from said first and second intermediate transfer members to said recording material, a pressing/detaching means separates said first and second intermediate transfer members from each other, whereas when the images are transferred from said first and second intermediate transfer members to said recording material, said pressing/detaching means brings said first and second intermediate transfer members into contact with or in proximity to each other.

10. The double-sided image forming apparatus of claim 2, wherein said first image carrier and said second image carrier are respectively made up of a group of color image carriers, each of which carries a plurality of image components, and said first and second intermediate transfer members retain and transfer the image components received from the group of color image carriers of said respective first and second image carriers.

11. The double-sided image forming apparatus of claim 2, wherein of the paths for carrying said recording material, a path corresponding to the secondary transfer area is provided substantially in a vertical direction, and fixing means is provided downstream of the secondary transfer area for fixing unfixed images formed on both sides of said recording material.

12. The double-sided image forming apparatus of claim 2, wherein sucking means is provided in front of the secondary transfer area for causing either said first intermediate transfer member or said second intermediate transfer member to suck said recording material.

13. The double-sided image forming apparatus of claim 2, wherein, in a case where said first intermediate transfer member and said second intermediate transfer member are formed into a belt, said intermediate secondary transfer means is provided with a transfer/fixing member which is wrapped by said first and second intermediate transfer members, and the images are transferred to be fixed from said intermediate transfer members to the respective sides of the recording material.

14. A double-sided image forming apparatus comprising:

a first image carrier for carrying a first image;

a first intermediate transfer member disposed so as to be opposite to the first image carrier;

first intermediate primary transfer means for primarily transferring the first image from the first image carrier to the first intermediate transfer member;

a second image carrier for carrying a second image;

a second intermediate transfer member disposed so as to be opposite to the second image carrier;

second intermediate primary transfer means for primarily transferring the second image from the second image carrier to the second intermediate transfer member;

first intermediate secondary transfer means for retaining the recording material in a sucked way so as to correspond to the second image formed on the second intermediate transfer material and for secondarily transferring the first transfer image from the first intermediate transfer member to the side of the recording material facing the first intermediate transfer member, in the area where the first intermediate transfer material and the second intermediate transfer material come into contact with or in proximity to each other; and second intermediate secondary transfer means provided subsequent to the first intermediate secondary transfer means for secondarily transferring the primarily transferred image from the second intermediate transfer member to the side of the recording material facing the second intermediate transfer member while the recording material is sucked and retained by the second intermediate transfer member.

15. The double-sided image forming apparatus of claim 14, wherein said first and second intermediate transfer members carry color images which are formed by transferring in multiple image components having a plurality of colors, and when said recording material passes through a secondary transfer area without transferring the images from said first and second intermediate transfer members to said recording material, a pressing/detaching means separates said first and second intermediate transfer members from each other, whereas when the images are transferred from said first and second intermediate transfer members to said recording material, said pressing/detaching means brings said first and second intermediate transfer members into contact with or in proximity to each other.

16. The double-sided image forming apparatus of claim 14, wherein said first image carrier and said second image carrier are respectively made up of a group of color image carriers, each of which carries a plurality of image components, and said first and second intermediate transfer members retain and transfer the image components received from the group of color image carriers of said respective first and second image carriers.

17. The double-sided image forming apparatus of claim 14, wherein of the paths for carrying said recording material, a path corresponding to the secondary transfer area is provided substantially in a vertical direction, and fixing means is provided downstream of the secondary transfer area for fixing unfixed images formed on both sides of said recording material.

18. The double-sided image forming apparatus of claim 14, wherein, in a case where said second intermediate transfer member is formed into a belt, said second intermediate transfer means is provided with a transfer/fixing member which is wrapped by a second intermediate transfer member, the second image is transferred to the second side of said recording material from said second intermediate transfer member, and the images are fixed on both sides of said recording material.

19. A double-sided image forming apparatus comprising:

a first image carrier for carrying a first image;

a second image carrier for carrying a second image; and bending/transfer means for transferring the images formed on the image carriers to the respective sides of the recording material in the area where the first and second image carriers come into contact with or in proximity to each other, as well as for affording bending stress to the recording material before and after the transfer area.

20. The double-sided image forming apparatus of claim 19, wherein said first and second image carriers are provided with an image formation carrier on which the images are formed and with an intermediate transfer member which is positioned opposite said image formation carrier and temporarily holds the images transferred from said image formation carrier, and bending/transfer means is provided in the area where the intermediate transfer members of said first and second image carriers come into contact with or in proximity to each other.

21. The double-sided image forming apparatus of claim 19, wherein said bending/transfer means includes;

a pair of transfer rollers disposed so as to be opposite to each other with said first and second image carriers sandwiched therebetween, and a line connecting between the center axes of the transfer rollers is arranged so as to form an angle with respect to the direction in which said recording material travels.

22. The double-sided image forming apparatus of claim 19, wherein the bending/transfer means is comprised of one transfer roller which is disposed opposite two transfer rollers with the first and second image carriers sandwiched therebetween.

23. The double-sided image forming apparatus of claim 19, wherein the bending/transfer means is comprised of a pair of transfer rollers disposed so as to be opposite to each other with the first and second image carriers sandwiched therebetween.

* * * * *